US011230774B2

(12) United States Patent
Zhang et al.

(10) Patent No.: US 11,230,774 B2
(45) Date of Patent: Jan. 25, 2022

(54) HOMOGENEOUSLY DISPERSED MULTIMETAL OXY-HYDROXIDE CATALYSTS

(71) Applicant: THE GOVERNING COUNCIL OF THE UNIVERSITY OF TORONTO, Toronto (CA)

(72) Inventors: Bo Zhang, Shanghai (CN); Xueli Zheng, Tianjin (CN); Oleksandr Voznyy, Thornhill (CA); Sjoerd Hoogland, Toronto (CA); Jixian Xu, Toronto (CA); Min Liu, Toronto (CA); Cao-Thang Dinh, Toronto (CA); Edward Sargent, Toronto (CA)

(73) Assignee: THE GOVERNING COUNCIL OF THE UNIVERSITY OF TORONTO, Toronto (CA)

( * ) Notice: Subject to any disclaimer, the term of this patent is extended or adjusted under 35 U.S.C. 154(b) by 74 days.

(21) Appl. No.: 15/419,672

(22) Filed: Jan. 30, 2017

(65) Prior Publication Data

US 2017/0218528 A1 Aug. 3, 2017

Related U.S. Application Data

(60) Provisional application No. 62/288,648, filed on Jan. 29, 2016, provisional application No. 62/312,266, filed on Mar. 23, 2016.

(51) Int. Cl.

| | |
|---|---|
| ***C25B 11/077*** | (2021.01) |
| ***C25B 11/051*** | (2021.01) |
| ***C25B 1/02*** | (2006.01) |

(52) U.S. Cl.

CPC ..... *C25B 11/077* (2021.01); *C25B 1/02* (2013.01); *C25B 11/051* (2021.01)

(58) Field of Classification Search

CPC .. C25B 1/02; C25B 1/04; C25B 11/04; C25B 11/0405; C25B 11/0442; C25B 11/0478;

(Continued)

(56) References Cited

U.S. PATENT DOCUMENTS

| | | | |
|---|---|---|---|
| 2015/0292095 | A1 | 10/2015 | Haber et al. |
| 2015/0368811 | A1 | 12/2015 | Gray et al. |

FOREIGN PATENT DOCUMENTS

| | | |
|---|---|---|
| CA | 2625922 | 4/2007 |
| CA | 2719157 | 10/2009 |

(Continued)

OTHER PUBLICATIONS

Smith et al ("Photochemical Route for Accessing Amorphous Metal Oxide Materials for Water Oxidation Catalysis", Science, 2013, vol. 340, Issue 6128, pp. 60-63 and supplemental information). (Year: 2013).*

(Continued)

*Primary Examiner* — Alexander W Keeling
(74) *Attorney, Agent, or Firm* — Hill & Schumacher

(57) ABSTRACT

The present disclosure provides substantially homogeneously dispersed multimetal oxy-hydroxide catalyst comprising at least two metals, at least one metal being a transition metal, and at least a second metal which is structurally dissimilar to at least one metal, such that the multimetal oxy-hydroxide is characterized by being substantially homogeneously dispersed and generally not crystalline. A key feature of the present materials is that the presence of the structurally dissimilar metal results in sufficient strain produced in the final multimetal oxy-hydroxide material to prevent crystallization from occurring. The resulting materials are specifically not annealed at tempera- (Continued)

tures that would induce crystallization in order to avoid the expected phase segregation that would occur during crystallization.

30 Claims, 18 Drawing Sheets

(58) Field of Classification Search
CPC ... C25B 11/00–11/097; H01M 4/8647; H01M 4/8652; H01M 9/016–9/033; B01J 23/47–23/755
See application file for complete search history.

(56) References Cited

FOREIGN PATENT DOCUMENTS

| | | |
|---|---|---|
| JP | 2002208399 A | 7/2002 |
| WO | 2010026131 | 3/2010 |

OTHER PUBLICATIONS

Mendoza-Garcia et al ("Controlled Anisotropic Growth of Co—Fe—P from Co—Fe—O Nanoparticles", Adgewandte Communications, 2015, 54, pp. 9642-9645). (Year: 2015).*
Trotochaud et al ("Solution-Cast Metal Oxide Thin Film Electrocatalysts for Oxygen Evolution", Journal of the American Chemical Society, 2012, 134, pp. 17253-17261). (Year: 2012).*
Fan et al ("Study of Electrodeposited Nickel-Molybdenum, Nickel-Tungsten, Cobalt-Molybdenum, and Cobalt-Tungsten as Hydrogen Electrodes in Alkaline Water Electrolysis", Journal of The Electrochemical Society, vol. 141, No. 2, 1994, pp. 382-387). (Year: 1994).*
Masa et al (Abstract of "Amorphous Cobalt Boride (Co2B) as a Highly Efficient Nonprecious Catalyst for Electrochemical Water Splitting: Oxygen and Hydrogen Evolution", Advanced Energy Materials, Jan. 7, 2016). (Year: 2016).*
Zhu et al ("A study of the electrochemistry of nickel hydroxide electrodes with various additives", Journal of Power Sources, 56, 1995, p. 75-79). (Year: 1995).*
Diaz-Morales et al ("Guidelines for the Rational Design of Ni-Based Double Hydroxide Electrocatalysts for the Oxygen Evolution Reaction", American Chemical Society Catalysis, 5, 2015, pp. 5380-5387) (Year: 2015).*
McCrory et al ("Benchmarking Hydrogen Evolving Reaction and Oxygen EvolvingReaction Electrocatalysts for Solar Water Splitting Devices", Journal of the American Chemical Society, 137, 2015, pp. 4347-4357) (Year: 2015).*
Smith et al ("Water Oxidation Catalysis: Electrocatalytic Response to Metal Stoichiometry in Amorphous Metal Oxide Films Containing Iron, Cobalt, and Nickel", Journal of the American Chemical Society, 135, 2013, pp. 11580-11586) (Year: 2013).*
Lutterman et al ("A Self-Healing Oxygen-Evolving Catalyst", Journal of the American Chemical Society, vol. 131, No. 11, 2009, pp. 3838-3839) (Year: 2009).*
Burke et al ("Cobalt-Iron (Oxy)hydroxide Oxygen Evolution Electrocatalysts: The Role of Structure and Composition on Activity, Stability, and Mechanism", Journal of The Electrochemical Society, 137 10, 2015, pp. 3638-3648) (Year: 2015).*
Chemelewski et al ("Amorphous FeOOH Oxygen Evolution Reaction Catalyst for Photoelectrochemical Water Splitting", Journal of the American Chemical Society, 2014, 136, pp. 2843-2850) (Year: 2014).*
Masa et al ("Amorphous Cobalt Boride (Co2B) as a Highly Efficient Nonprecious Catalyst for Electrochemical Water Splitting: Oxygen and Hydrogen Evolution", Advanced Energy Materials, Jan. 7, 2016) (Year: 2016).*
Smith et al ("Photochemical Route for Accessing Amorphous Metal Oxide Materials for Water Oxidation Catalysis", Science, vol. 340, 2013, pp. 60-63). (Year: 2013).*
Liu et al ("Synthesis and electrochemical performance of amorphous nickel hydroxide codoped with Fe3+ and CO32−", Ionics, 2010, 16, pp. 215-219). (Year: 2010).*
Hassan et al. ("Electroless Ni—B supported on carbon for direct alcohol fuel cell applications", International Journal of Hydrogen Energy, 36, 2011, pp. 849-856). (Year: 2011).*
Ozerova et al ("Cobalt borate catalysts for hydrogen production via hydrolysis of sodium borohydride", Journal of Alloys and Compounds, 513, 2012, pp. 266-272). (Year: 2012).*
Fisher et al ("Investigation Into the Microstructure of Iron-Chromium Oxyhydroxide Fine Particles", Hyperfine Interactions C, 2001, pp. 367-370 of Fisher) (Year: 2001).*
International Search Report PCT/CA2017/050106 dated May 23, 2017.
Written Opinion PCT/CA2017/050106 dated May 23, 2017.
C. R. Cox, J. Z. Lee, D. G. Nocera, T. Buonassisi, Proc. Natl. Acad. Sci. U.S.A., (2014).
J. Luo et al., Science 345, 1593 (2014).
M. Schreier et al., Nat. Commun. 6, (2015).
R. D. L. Smith et al., Science 340, 60 (2013).
D. Friebelet al., J. Am. Chem. Soc. 137, 1305 (2015).
J. Suntivich, K. J. May, H. A. Gasteiger, J. B. Goodenough, Y. Shao-Horn, Science 334, 1383 (2011).
M. W. Kanan, D. G. Nocera, Science 321, 1072 (2008).
M. Dincă, Y. Surendranath, D. G. Nocera, Proc. Natl. Acad. Sci. U.S.A. 107, 10337 (2010).
F. M. Toma et al., Nat. Chem. 2, 826 (2010).
Q. Yin et al., Science 328, 342 (2010).
J. A. Haber, E. Anzenburg, J. Yano, C. Kisielowski, J. M. Gregoire, Advanced Energy Materials 5, 1402307 (2015).
D. Friebel et al., PCCP 15, 17460 (2013).
W. Ma et al., ACS Nano 9, 1977 (2015).
R. Ma, J. Liang, K. Takada, T. Sasaki, J. Am. Chem. Soc. 133, 613 (2011).

* cited by examiner

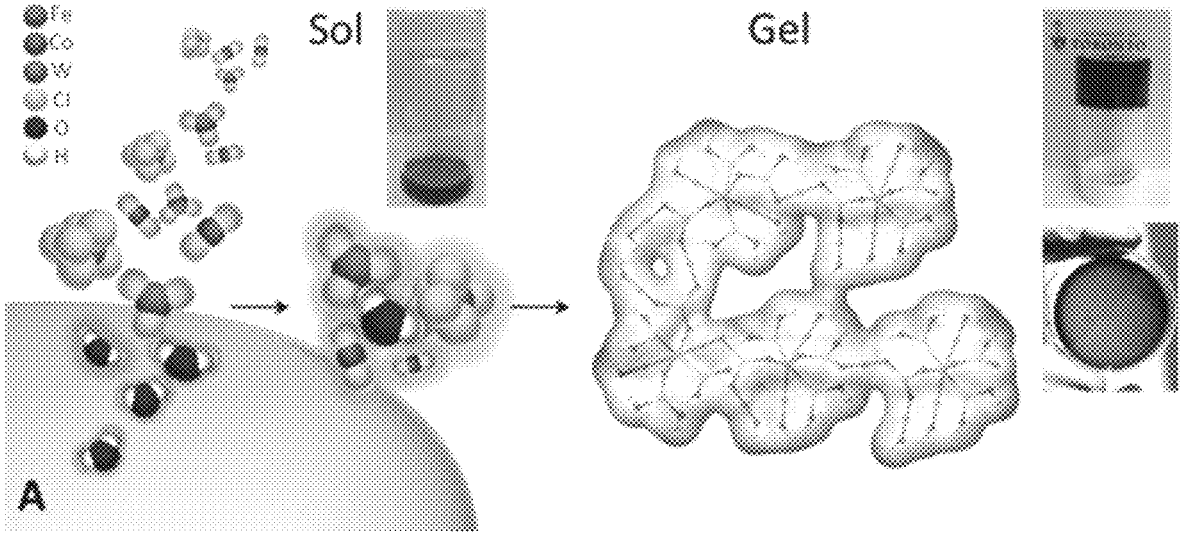
Figure 1A
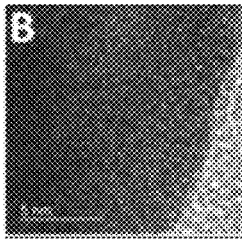
Figure 1B
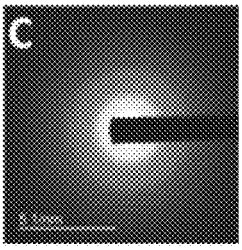
Figure 1C
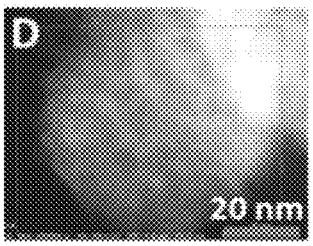
Figure 1D
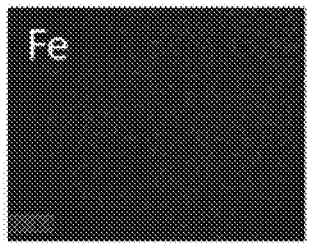
Figure 1D1
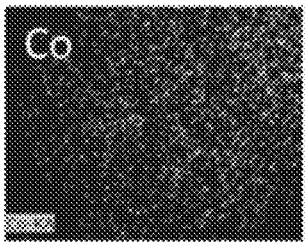
Figure 1D2
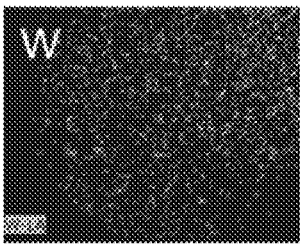
Figure 1D3
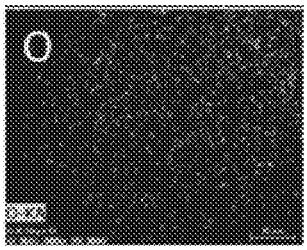
Figure 1D4
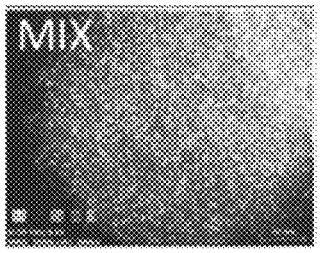
Figure 1D5

Figure 3A
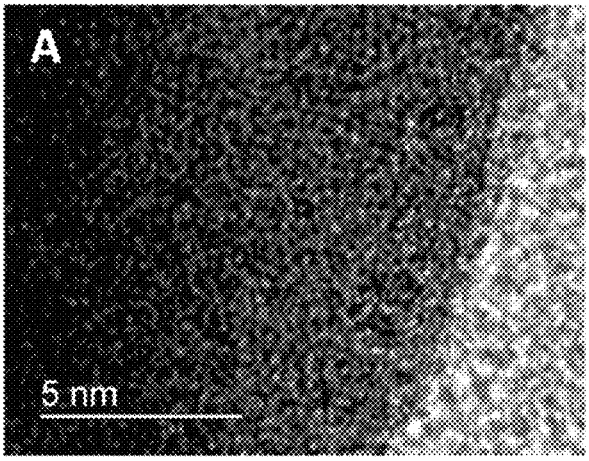
Figure 3B
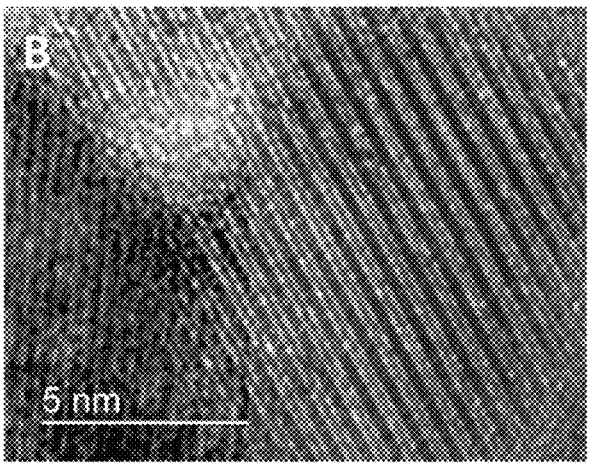
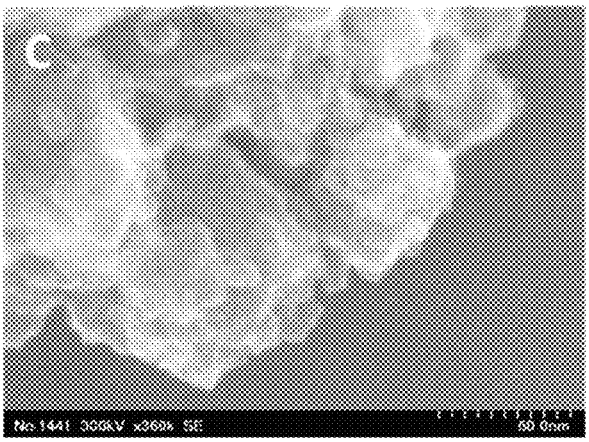
Figure 3C
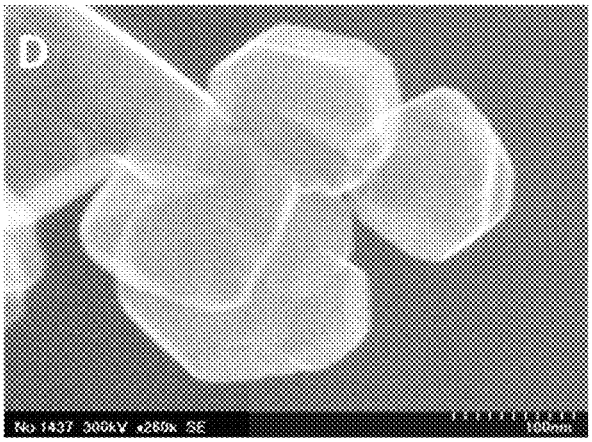
Figure 3D

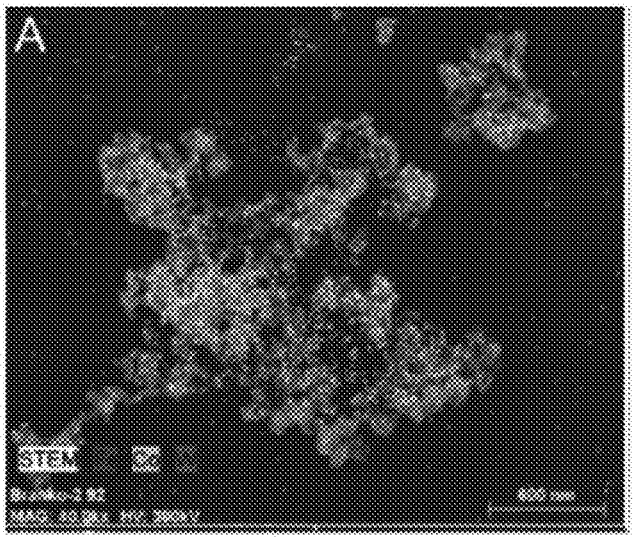
Figure 4A
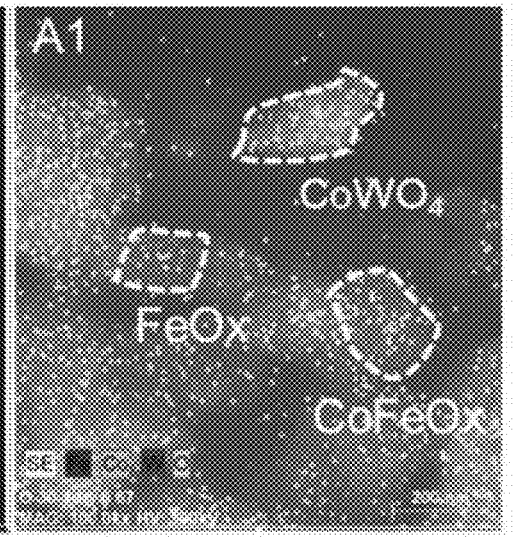
Figure 4A1
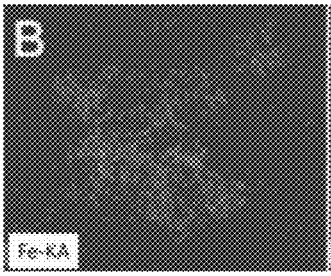
Figure 4B
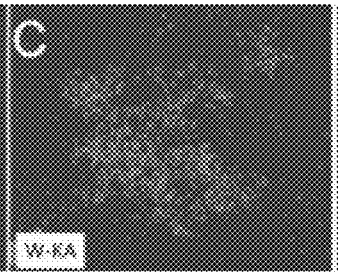
Figure 4C
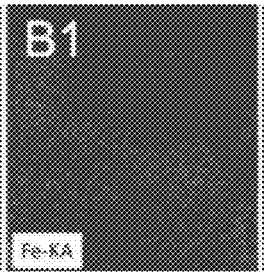
Figure 4B1
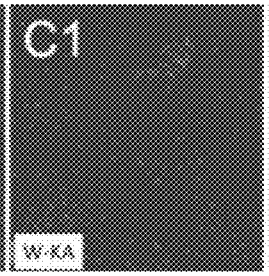
Figure 4C1
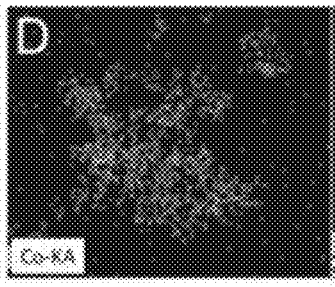
Figure 4D
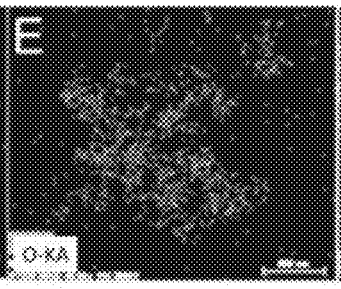
Figure 4E
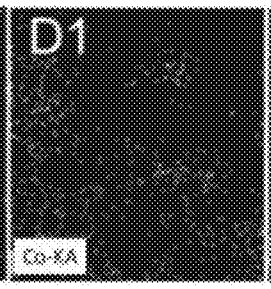
Figure 4D1
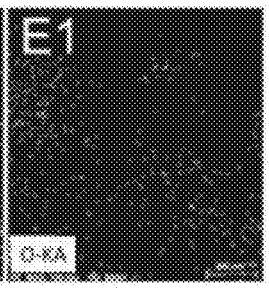
Figure 4E1

Figure 6A
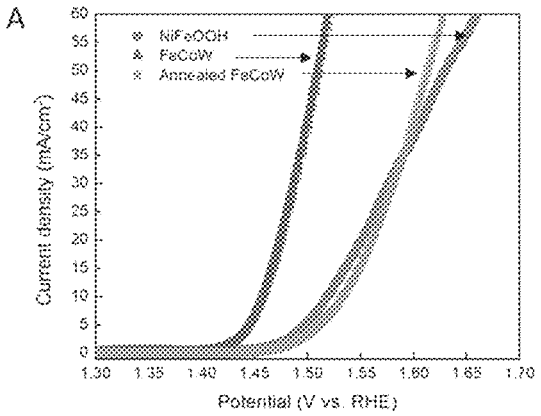
Figure 6B
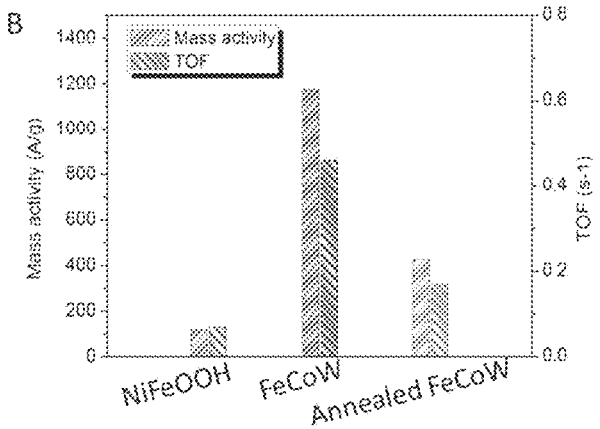
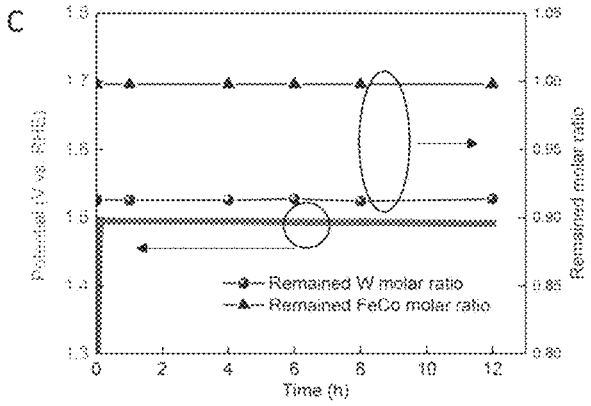
Figure 6C
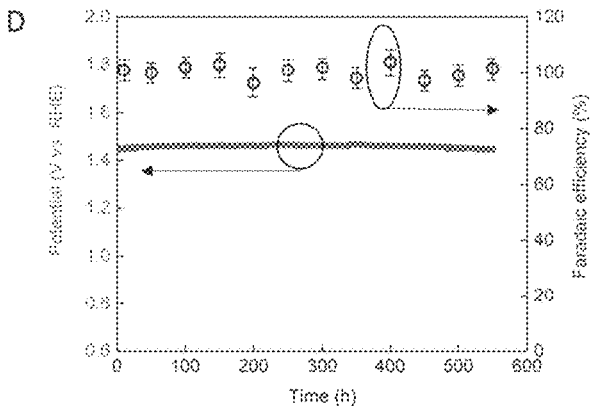
Figure 6D

HOMOGENEOUSLY DISPERSED MULTIMETAL OXY-HYDROXIDE CATALYSTS

FIELD

The present disclosure relates to homogeneously dispersed multimetal catalysts. Exemplary embodiments include oxygen-evolving and $CO_2$ reduction catalysts for the production of chemically stored energy from electricity. Embodiments include multimetal oxy-hydroxides. Embodiments of the present disclosure include methods of production of the catalysts.

BACKGROUND

Efficient, cost-effective and long-lived electrolysers are a crucial missing piece along the path to practical energy storage. Energy storage is important in a number of application areas including the storage of energy obtained from renewable sources, including electricity (1, 2). One limiting factor in improving water-splitting technologies is the oxygen evolution reaction (OER). The most efficient available catalysts require a substantial overpotential to reach the desired current densities ~10 mA $cm^{-2}$ (2, 3) even in favorable electrolyte pH (typically pH~13-14). To date, the best OER catalysts in alkaline media are NiFe oxy-hydroxide materials which typically require an overpotential of over 280 mV at a current density of 10 mA $cm^{-2}$. Materials based on earth-abundant first-row (3d) transition metals, including 3d metal oxy-hydroxides (4, 5), oxide perovskites (6), cobalt phosphate composites (7), nickel borate composites (8), and molecular complexes (9, 10), are of interest in overcoming these limitations and improving catalysts.

A drawback to current OER electrode compositions is the lack of fine control over the adsorption energetics of the various OER intermediates (O, OH, and OOH) with respect to the adsorption energetics optimal for maximum efficiency OER. Intercalation of additional elements, so called modulators, into the active catalyst matrix can be used to modulate the activity of the nearby active catalytic atomic sites. However, the choice of modulator is limited to elements of similar atomic size to that of the host matrix, whereas significantly larger or smaller elements tend to phase segregate due to lattice mismatch and strain accumulation, thus limiting the effect of modulators to the few nearest sites in the host matrix (11-13).

SUMMARY

The present disclosure provides a substantially homogeneously dispersed multimetal oxy-hydroxide catalyst comprising at least two metals, at least one metal being a transition metal, and at least a second metal which is structurally dissimilar to the at least one metal, such that the multimetal oxy-hydroxide is characterized by being substantially homogeneously dispersed on sub-10 nm scale and generally not crystalline. In an embodiment, a multimetal catalyst can be produced from this multimetal oxy-hydroxide catalyst by exposing the later to a reducing environment.

An exemplary reducing environment is provided by electrochemically reducing the homogeneously dispersed multimetal oxy-hydroxide catalyst.

The present disclosure provides a substantially homogeneously dispersed multimetal oxy-hydroxide catalyst comprising at least two metals, at least one of the metals being from a first class of metals which includes Ni, Fe and Co, and at least one metal or non-metal which are structurally dissimilar to the metal in the first class, the at least one metal being from a second class of metals which are structurally dissimilar to the metals in the first class and includes W, Mo, Mn, Mg, Cr, Ba, Sb, Bi, Sn, Ce, Pb, Ir and Re, and the non-metal being one of B and P.

The present disclosure provides a homogeneously dispersed multimetal oxy-hydroxide catalyst made using multimetals with at least one of them being structurally dissimilar to the other metals, comprising:

a homogeneously dispersed multimetal oxy-hydroxide catalyst coated on said conductive substrate, said homogeneously dispersed multimetal oxy-hydroxide comprising a first metal being iron (Fe), a second metal being one or both of cobalt (Co) and nickel (Ni), and when the second metal is cobalt, including at least a third element M3 which is any one or combination of tungsten (W), molybdenum (Mo), tin (Sn), and chromium (Cr);

when the second metal is nickel, including a third element M3 which is any one of any one of antimony (Sb), rhenium (Re), iridium (Ir), manganese (Mn), magnesium (Mg), boron (B) and phosphorus (P); and when the second metal is both cobalt (Co) and nickel (Ni), including an additional element which is at least one of boron (B) and phosphorus (P).

In this embodiment, when the second metal is cobalt, a ratio of the Fe:Co:M3 being 1:X:Y, wherein X ranges from about 0.1 to about 10, and Y ranges from about 0.001 to about 10.

When the second metal is cobalt, a ratio of the Fe:Co:M3 being 1:X:Y, wherein X ranges from about 0.5 to about 1.5, Y ranges from about 0.5 to about 1.5.

When the second metal is nickel, a ratio of the Fe:Ni:M3 being 1:X:Y, wherein X ranges from about 0.1 to about 10, and Y ranges from about 0.001 to about 10.

When the second metal is nickel, a ratio of the Fe:Ni:M3 being 1:X:Y, wherein X ranges from about 5 to about 10, Y ranges from about 0.5 to about 1.5.

When the second metal is cobalt and the third element is tungsten (W), including a fourth element which is molybdenum (Mo) and a ratio of the Fe:Co:W:Mo being about 1:X:Y:Z, wherein X ranges from about 0.1 to about 10, Y ranges from about 0.001 to about 10, and Z ranges from about 0.001 to about 10. A preferred ratio 1:X:Y:Z is about 1:1:0.5:0.5.

When the second metal is both cobalt (Co) and nickel (Ni), the third element is phosphorus (P) and a broad ratio of the FeCoNiP is 1:0.1-10:1-100:0.001-10. A more preferred ratio of the FeCoNiP is 1:1:9:0.1.

These homogeneously dispersed multimetal oxy-hydroxide catalysts have shown excellent efficacy as oxygen evolution electrodes.

The present disclosure provides a method for producing a homogeneously dispersed multimetal oxy-hydroxide catalyst for oxygen evolution, comprising:

a) dissolving metal salt precursors for at least three different metals in a first polar organic solvent to produce a first solution containing metal ions of the at least three different metals, a first metal being iron (Fe), and a second metal being one of cobalt (Co), and nickel (Ni); and when the second metal is cobalt, including any one of tungsten (W), molybdenum (Mo), tin (Sn) and chromium (Cr);

and when the second metal is nickel, including any one of antimony (Sb), rhenium (Re), iridium (Ir), cobalt (Co), Magnesium (Mg) and manganese (Mn);

and when the second and third metal are Co and Ni, the fourth element is any one of B and P b) chilling the first solution;

c) mixing trace amounts of water in the first polar organic solvent to produce a second solution;

d) chilling the second solution;

e) mixing the chilled first solution together with the chilled second solution and optionally with an agent selected to control a rate of hydrolysis of all the metals and letting the mixture react over a preselected period of time to form a gel;

f) soaking the gel in a second polar organic solvent to remove unreacted precursors and any unreacted agent from the gel; and g) drying the gel in the absence of annealing to produce an uncrystallised powder aerogel, wherein the uncrystallised powder aerogel is characterized by being a homogeneously dispersed multimetal oxy-hydroxide catalyst material.

In an embodiment there is provided a method for producing a homogeneously dispersed multimetal catalyst for $CO_2$ reduction, comprising:

a) dissolving metal salt precursors for at least two different metals in a first polar organic solvent to produce a first solution containing metal ions of the two different metals, a first metal being copper (Cu), and the second metal is any one of Cerium (Ce), Bismuth (Bi), Tin (Sn) and Lead (Pb). All the above metal elements can also be prepared as single metal oxyhydroxides via the same method as claimed below.

b) chilling the first solution;

c) mixing trace amounts of water in the first polar organic solvent to produce a second solution;

d) chilling the second solution;

e) mixing the chilled first solution together with the chilled second solution and optionally with an agent selected to control a rate of hydrolysis of all the metals and letting the mixture react over a preselected period of time to form a gel;

f) soaking the gel in a second polar organic solvent to remove unreacted precursors and any unreacted agent from the gel;

g) drying the gel in the absence of annealing to produce an uncrystallised powder aerogel, wherein the uncrystallised powder aerogel is characterized by being a homogeneously dispersed multimetal oxy-hydroxide catalyst material; and h) exposing the obtained gel to reducing conditions.

Thus, the present disclosure provides $CO_2$ reduction reaction catalysts prepared starting from the homogeneously dispersed multimetal oxy-hydroxide and electrochemically reducing it. The present disclosure provides a $CO_2$ reduction reaction catalyst, comprising: a homogeneous mixture of Cu with a second metal M, including one of Cerium (Ce), Bismuth (Bi), Tin (Sn) and Lead (Pb). A broad ratio of the Cu:M being 1:X, where X ranges from about 0.01 to about 10. A preferred narrower range in the particular example of the Cu:Ce is 1:X, where X ranges from about 0.1 to about 1.

A further understanding of the functional and advantageous aspects of the disclosure can be realized by reference to the following detailed description and drawings.

BRIEF DESCRIPTION OF THE DRAWINGS

Embodiments will now be described, by way of example only, with reference to the drawings, in which:

FIGS. 1A-1D5 Preparation of homogeneously dispersed FeCoW oxy-hydroxides catalysts. FIG. 1A Schematic illustration of preparation process for the gelled structure and pictures of corresponding sol, gel and gelled film. FIG. 1B High resolution transmission electron microscopy (HR-TEM) of FeCoW oxy-hydroxides. FIG. 1C Selected area electron diffraction (SAED) pattern. FIG. 1D is Scanning transmission electron microscopy (STEM) image, with the subpanels labelled as FIGS. 1D1, 1D2, 1D3 and 1D4 showing the selected area elemental mapping using energy dispersive X-ray microanalysis (EDS) for Fe, Co, W, and O, respectively. FIG. 1D5 shows an overlay of the above four elements to demonstrate their homogeneous mixing.

FIGS. 3A-3D HRTEM and STEM images for gelled FeCoW (G-FeCoW) catalysts and annealed FeCoW (A-FeCoW). FIGS. 3A and 3B HRTEM images of G-FeCoW showed no obvious lattice fringes while A-FeCoW revealed crystalline phase. FIGS. 3C and 3D High resolution STEM images of G-FeCoW and A-FeCoW, respectively. A-FeCoW showed a smooth surface, a characteristic of large single crystals.

FIGS. 4A-4E1. EDS mapping for gelled FeCoW (G-FeCoW) catalysts and annealed FeCoW (A-FeCoW). FIGS. 4A and 4A1 STEM images of G-FeCoW and A-FeCoW. FIGS. 4B, 4C, 4D, and 4E Mapping of G-FeCoW for Fe, Co, W and O elements, respectively, demonstrating a homogeneous distribution of the elements. FIGS. 4B1, 4C1, 4D1, and 4E1 Mapping of A-FeCoW for Fe, Co, W and O elements, respectively, showing phase separation of $CoWO_4$ and $FeO_x$.

FIG. 5A Surface sensitive TEY XAS scans at the Fe L-edge before and after OER at +1.4 V (vs. RHE), with the corresponding molar ratio of $Fe^{2+}$ and $Fe^{3+}$ species. FIG. 5B Surface sensitive TEY XAS scans at the Co L-edge before and after OER at +1.4 V (vs. RHE). FIG. 5C Bulk Co K-edge XANES spectra before and after OER at +1.4 V (vs. RHE). FIG. 5D The zoomed pre-edge profiles of Co K-edge XANES spectra before and after OER at +1.4 V (vs. RHE); The Co K-edge data of $Co(OH)_2$ and CoOOH are from (12). FIG. 5E Bulk W L3-edge XANES spectra before and after OER at +1.4 V (vs. RHE).

FIGS. 6A-6D Performance of gelled FeCoW (G-FeCoW) oxy-hydroxide catalysts and controls in three-electrode configuration in 1 M KOH aqueous electrolyte. FIG. 6A The OER polarization curve of catalysts loaded on glass carbon electrodes with 1 mV $s^{-1}$ scan rate, without iR-correction; FIG. 6B Mass activities and TOFs obtained at iR-corrected overpotential of 300 mV. FIG. 6C Chronopotentiometric curves obtained with the G-FeCoW oxy-hydroxides on gold-plated Ni foam electrode with constant current densities of 30 mA $cm^{-2}$, and the corresponding remaining metal molar ratio in G-FeCoW calculated from ICP-AES results. FIG. 6D Chronopotentiometric curves obtained with the G-FeCoW oxy-hydroxides on gold-plated Ni foam electrode with constant current densities of 30 mA $cm^{-2}$, and the corresponding Faradaic efficiency from gas chromatography measurement of evolved $O_2$.

FIG. 16A the reducing CV curves of gelled CuCe; FIG. 16B Stability running at −1.4V vs. RHE.

Figure 2A:
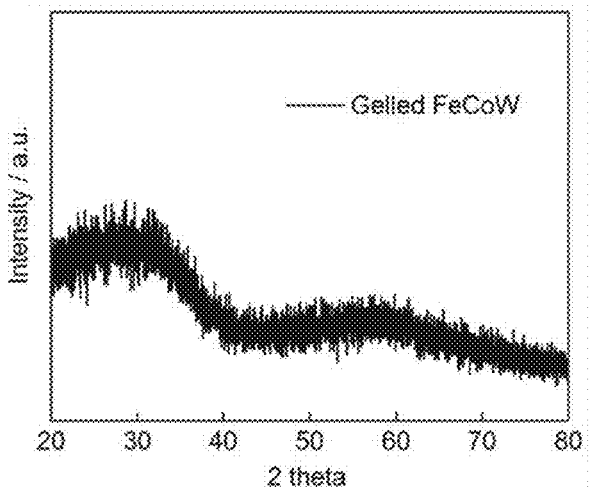
FIGS. 2A-2B X-ray diffraction (XRD) of Gelled FeCoW oxy-hydroxides (G-FeCoW) catalysts FIG. 2A and Annealed FeCoW (A-FeCoW) FIG. 2B at different temperatures. Gelled catalyst revealed no evidence for a crystalline phase, while FeCoW annealed at 500° C. and 1000° C. shown separated $CoWO_4$, $Fe_3O_4$ and $Co_3O_4$ crystalline phases.

Table 1. Oxygen evolution reaction parameters for gelled multimetal FeCoW oxyhydroxide compared with the state-of-the-art NiFeOOH tested on GCE in the same environment. Each sample was repeated independently three times.

Table 2. Oxygen evolution reaction overpotential for gelled multimetal oxyhydroxides compared with the state-of-the-art NiFeOOH tested on GCE in the same environment.

DETAILED DESCRIPTION

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms "comprises" and "comprising" are to be construed as being inclusive and open ended, and not exclusive. Specifically, when used in the specification and claims, the terms "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately" are meant to cover variations that may exist in the upper and lower limits of the ranges of values, such as variations in properties, parameters, and dimensions.

As used herein the phrase "metal oxy-hydroxide" means a compound with a general composition $Me_2(O_x(OH)_{2(1-x)})_n$, where n is the metal valence, and x can be anywhere in the range from 0 (including 0) up to 1 (including 1), i.e. pure metal oxide (x=1), pure metal hydroxides (x=0), and mixtures of thereof, (0<x<1).

As used herein the phrase "structurally dissimilar metals" means metal atoms with a covalent radii differing by more than about 6%.

As used herein the phrase "homogenously dispersed multimetal oxy-hydroxide" means a material in which extended regions exist where the claimed metals are distributed in a common oxy-hydroxide framework, homogeneously on a length scale of few nanometers, as detectable using such experimental techniques as TEM, EDX, EELS, but with the general idea that the material should be homogeneous on atomic level, i.e. at least some metal atoms connect to more than one species of metallic atoms through a bridging oxygen (or bridging hydroxide), thus allowing for electronic modulation by the neighboring metal(s) in order to tune the adsorption energetics of the OER intermediates.

The catalysts produced and disclosed herein are characterized by being amorphous, in order to allow for a "homogeneous dispersion" of "structurally dissimilar metals" which otherwise tend to phase separate due to strain if in crystalline form.

It is contemplated that only the homogeneously mixed regions on the surface of the catalyst provide the enhanced activity. For sake of clarity, it is not contemplated the entire surface is required to be covered with the homogeneous mixture.

As used herein the term "electrode" means an electronically conductive substrate coated with the present homogeneously dispersed multimetal oxy-hydroxides, with the latter being referred to as a catalyst.

Earth-abundant first-row (3d) transition-metal-based catalysts have been developed for the oxygen-evolution reaction (OER); however, they operate at overpotentials significantly above thermodynamic requirements. Non-3d high-valency metals, such as tungsten, can modulate 3d metal oxy-hydroxides beyond what is achievable with conventional 3d alloys, allowing one to tune the adsorption energies for OER intermediates (O, OH, and OOH) closer to the thermodynamic optimum energy values. This is achievable when the catalytically active metal site has more than one type of metal in its next-nearest neighbor shell (with the nearest neighbor being oxygen). Increasing the amount of such active sites requires metals to be mixed homogeneously within the materials. However, this is hardly achievable in a crystalline structure when metal atomic radii differ by more than ~6%. The mismatching elements tend to phase-separate to release the strain energy.

The present inventors have developed a room-temperature synthesis to produce homogenously dispersed multimetal oxy-hydroxide materials with an atomically homogeneous metal, oxygen and hydroxide distribution. The present disclosure provides a catalyst of a spatially homogeneously distributed set of metal oxy-hydroxides with sufficiently different structural properties. One metal is from a first class, the "active site" (corresponding to Co, Fe, Ni, Mn, Ti, Cu and Zn) and at least one metal or non-metal is from a second class, the "modulator" (wherein the metal may be any one of W, Sn, Mn, Ba, Cr, Ir, Re, Mo, Sb, Bi, Sn, Pb, Ce, Mg, and the non-metal may be B or P), which tunes the adsorption energetics of the reaction intermediates on the "active site". While Zinc (Zn) is not technically a "transition metal", it is contemplated to behave as one for various electrochemical reactions.

The inventors have discovered that a broader choice of metal oxy-hydroxides can be mixed with various combinations of two (2) or more metals which exhibit excellent efficacy as catalysts. A key requirement for these mixed metal oxy-hydroxides is that they are homogenously dispersed as described above, and ideally, but not limited to, full coverage of the surface. While it is contemplated that full coverage of the surface would give the best results, without being limited by any theory, the inventors believe excellent catalytic activity is achievable with only partial coverage.

The above metal oxy-hydroxides can be used as oxygen evolution reaction electrodes and $CO_2$ reduction reaction electrodes. The inventors contemplate that when the above metal oxy-hydroxides are exposed to reducing conditions during the $CO_2$ reduction reaction, they will lose their oxy-hydroxyde structure due to reduction but may maintain the homogeneity of the mixture of metals.

Possible non-electrochemical reducing conditions include exposing the as-formed catalysts to a hydrogen gas atmosphere, heating up to but not exceeding 300° C. (otherwise the catalyst will be annealed and will phase-separate). Alternatively, the catalysts may be formed into electrodes and subjected to electrochemical reducing conditions using an aqueous solution which may be neutral or alkaline, and using a negative reducing potential, i.e. anything below 0 V RHE.

In an exemplary such experiment, the solution was $CO_2$-saturated 0.5M $KHCO_3$ used for $CO_2$ reduction reaction. However it will be understood that the solution does not need to contain $CO_2$ or $KHCO_3$ or anything else specific for the catalyst material to reduced. It also does not require high negative voltage. Anything <0 vs. RHE should be enough to effect reduction of the catalyst material.

In specific embodiments, the multimetal oxy-hydroxide based OER electrodes contain three (3) or more metals selected to optimize binding of OER intermediates (O, OH, OOH) to the surface of the electrode which is required for efficient electrolysis. The electrode materials are homogenously dispersed multimetal oxy-hydroxides of structurally dissimilar metals which are coated onto a conductive substrate. In specific embodiments, these multimetal oxy-hydroxides all include iron (Fe). In specific embodiments, the second metal may be cobalt (Co) or nickel (Ni) or both. In specific embodiments, when the second metal is cobalt, additional elements (M3) may include any one of tungsten (W), molybdenum (Mo), tin (Sn), and chromium (Cr), a broad ratio of the Fe:Co:M3 being 1:X:Y, where X ranges from about 0.1 to about 10, Y ranges from about 0.001 to about 10. A preferred narrower range of the Fe:Co:M3 is 1:X:Y, wherein X ranges from about 0.5 to about 1.5, Y ranges from about 0.5 to about 1.5.

In specific embodiments, when the second metal is nickel, additional elements may include any one of antimony (Sb), rhenium (Re), iridium (Ir), Barium (Ba), magnesium (Mg) and manganese (Mn), a broad ratio of the Fe:Ni:M3 being 1:X:Y, where X ranges from about 1 to about 100, Y ranges from about 0.001 to about 10. A preferred narrower range of the Fe:Co:M3 is 1:X:Y, where X ranges from about 5 to about 10, Y ranges from about 0.5 to about 1.5.

In specific embodiments, when the second and third metals are nickel and cobalt, the fourth element may be any one of phosphorus (P) and boron (B), a broad ratio of the Fe:Co:Ni:M4 being 1:X:Y:Z, where X ranges from about 0.1 to about 10, Y ranges from about 1 to about 100, Z ranges from 0.001 to 10. A preferred narrower range of the Fe:Co:Ni:M4 is 1:X:Y:Z, where X ranges from about 0.9 to about 1.1, Y ranges from about 8 to about 10, Z ranges from about 0.05 to about 0.2.

In specific embodiments relevant for $CO_2$ reduction reaction, the first metal is copper (Cu), and the second metal (M2) is any one of Cerium (Ce), Bismuth (Bi), Tin (Sn) and Lead (Pb). A broad ratio of the Cu:M2 being 1:X, where X ranges from about 0.01 to about 10. A preferred narrower range of the Cu:Ce is 1:X, where X ranges from about 0.1 to about 1.

The room-temperature synthesis disclosed herein to produce amorphous oxy-hydroxide materials with an atomically homogeneous metal distribution includes dissolving inorganic metal salt precursors for at least three different metals in a first polar organic solvent to produce a first solution containing metal ions of the at least three different metals. Various salts may be used including chlorides, nitrates, sulphates (depending on solubility in the polar organic solvents used) just to mention a few non-limiting inorganic salts.

A first metal is iron (Fe), and a second metal may be either cobalt (Co), or nickel (Ni). When the second metal is cobalt, third element may be any one of tungsten (W), molybdenum (Mo), tin (Sn), chromium (Cr), and nickel (Ni). The ranges of the concentration of these different components is as discussed above. When the second metal is nickel, the third element may be any one of antimony (Sb), rhenium (Re), iridium (Ir), Barium (Ba), Magnesium (Mg) and Manganese (Mn) with the composition ranges given above. When the second and third metals are nickel and cobalt, the fourth element may be any one of phosphorus (P) and boron (B). The synthesis method includes chilling the first solution to a temperature in the range between about −10° C. and 0° C. A second solution comprised of trace amounts of water dissolved in the first polar organic solvent is then produced and then chilled to −10° C. to about 0° C. Various polar organic solvents that may be used include, but are not limited to methanol, ethanol, 2-propanol, and butanol.

The amount of trace water required is determined by calculating the mole number of positive charge of cations, e.g., assuming 1 mole of $M^{2+}$ needs 2 moles of $H_2O$.

The first and second chilled solutions are then mixed together and optionally mixed with an agent selected to control a rate of hydrolysis of one or two constituent metals and letting the mixture react over a preselected period of time from about 10 mins to about 48 hours to form and age a gel at room temperature.

A preferred narrow time range is about 12 hours to about 36 hours. It will be understood that it may not be necessary to control the rate of hydrolysis of all the metals when the hydrolysis rate of the corresponding precursors are comparable, enabling homogeneous dispersion. When the hydrolysis rate of the corresponding precursors are different, the hydrolysis controlling agent is required. A preferred agent is an epoxide, which acts as a proton scavenger coordinating the hydrolysis rate. Various epoxides that may be used include, but are not limited to propylene oxide, cis-2,3-exposybutane, 1,2-epoxybutane, glycidol, epichlorohydrin, epibromohydrin, epifluorohydrin, 3,3, -dimethyloxetane, and trimethylene.

Trace amount of water are used to slow down all metal precursors' hydrolysis rate, and the epoxide is used to increase the hydrolysis rate of those precursors which have too slow of a hydrolysis rate, and to drive polycondensation reactions and prevent precipitation.

After the mixture has sat undisturbed long enough for the gelation process to complete, the resulting gel is soaked in a second polar organic solvent to remove unreacted precursors and any unreacted hydrolysis inducing agent from the gel. Various polar organic solvents that are useful for this include but not limited to acetone, ethanol, benzene and diethyl ether.

Once the gel has been cleared of the unreacted reagents, the gel is dried to produce a powder aerogel. A preferred method for drying the gel includes using supercritical $CO_2$ liquid. However other methods may be used including other supercritical fluid drying, freeze drying, and vacuum drying.

The powdered aerogel is then mixed with a mixture of water, an adhesion agent and an organic solvent to produce a slurry. The adhesion agent in this step may include, but is not limited to Nafion solution, polyvinylidene fluoride (PVDF) solution and polytetrafluoroethylene (PTFE) solution. The organic solvent in this step may include, but is not limited to ethanol, methanol, 2-propanol and dimethyl formamide.

The slurry is then spread over a conductive substrate and dried to form a film, thereby producing a mixed metal oxide film which is characterized by being a homogenously dispersed amorphous metal oxide. The thickness of this film may be in a range from about 10 nm to about 10 um. A preferred thickness for a good performance in catalysis applications is in a range from about 400 nm to about 2 um.

The present catalysts made of amorphous homogeneously dispersed multimetal oxy-hydroxides for OER are very advantageous over the OER electrodes based on crystallized mixed metal oxides since in the present we have a priori control over the homogenous distribution of the active metal-oxy-hydroxide sites. The presence of different metal sites in close proximity provides fine tuning of the OER energetics. In the conventional OER mixed metal oxide electrodes this fine tuning does not a priori exist since the different metal oxide components are phase separated. Since these conventional starting catalysts are a dispersion of metal oxides this dispersion may become hydroxylated during operation of the OER, but the distribution of metal active sites is not controlled as they advantageously are with the present method.

The present catalysts made of amorphous homogeneously dispersed multimetal oxy-hydroxides derived catalysts for $CO_2$ reduction are very advantageous, thanks to the significant interactions between different metal atoms.

The homogeneously dispersed structurally dissimilar multimetal oxy-hydroxide electrodes produced in accordance with the present disclosure will now be illustrated with the following non-limiting examples.

Example 1

Exemplary Mixed Metal Oxy-Hydroxide Synthesis

Gelled FeCoW oxy-hydroxides (G-FeCoW) were synthesized using a modified aqueous sol-gel technique as discussed above. Anhydrous $FeCl_3$ (0.9 mmol), $CoCl_2$ (0.9 mmol) and $WCl_6$ (0.9 mmol) were first dissolved in ethanol (2 mL) in a vial. A solution of deionized water (DI) (0.18 mL) in ethanol (2 mL) was prepared in a separate vial. All solutions mentioned above were cooled in an ice bath for 2 h in order to prevent uncontrolled hydrolysis and condensation which may lead to the formation of precipitate rather than gel formation. The Fe, Co and W precursors were then mixed with an ethanol-water mixture to form a clear solution. To this solution, propylene oxide (≈1 mL) was then slowly added, forming a dark green gel. The FeCoW wet-gel was aged for 1 day to promote network formation, immersed in acetone, which was replaced periodically for 5 days before the gel was supercritically dried using $CO_2$. The resulting aerogel powder was not annealed, as this would cause loss of control over the OER energetics as discussed above.

Figure 2B:
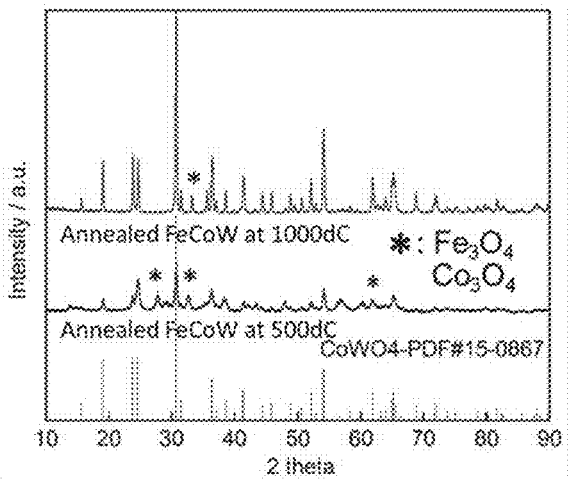

After supercritical drying with $CO_2$, the gel transformed into an amorphous metal oxy-hydroxide aerogel powder. From inductively coupled plasma optical emission spectrometry (ICP-OES) analysis, we determined the molar ratio of Fe:Co:W to be 1:1.02:0.70. High resolution transmission electron microscopy (HRTEM) (FIG. 1B), combined with selected-area electron diffraction (SAED) analysis (FIG. 1C), revealed the absence of a crystalline phase. X-ray diffraction (XRD) (FIG. 2A) further confirmed that the FeCoW oxy-hydroxide is an amorphous phase. Energy-dispersive X-ray spectroscopy (EDX) elemental maps with 1 nanometer resolution (FIG. 1D and FIG. 4 A-E) showed a uniform (i.e., homogeneous), uncorrelated spatial distribution of Fe, Co, and W. This homogeneity results from (i) the homogeneous dispersion of three precursors in solution and (ii) controlled hydrolysis, the latter enabling the maintenance of the homogeneous phase in the final gel state without phase separation of different metals caused by precipitation. In contrast, conventional processes (13, 14) even when their precursors are homogeneously mixed, result in crystalline products formed heterogeneously from the liquid phase, leading to phase separation caused by lattice mismatch. For structural comparison with prior sol-gel reports that used an annealing step, we annealed the samples at 500° C., and then found crystalline phases (HRTEM images FIG. 3B, XRD FIG. 2B) that included separated $Fe_3O_4$, $Co_3O_4$ and $CoWO_4$. Elemental mapping of this sample (FIG. 4A1-4E1) further confirmed the phase separation of Fe from Co and W atoms.

Figure 5A:
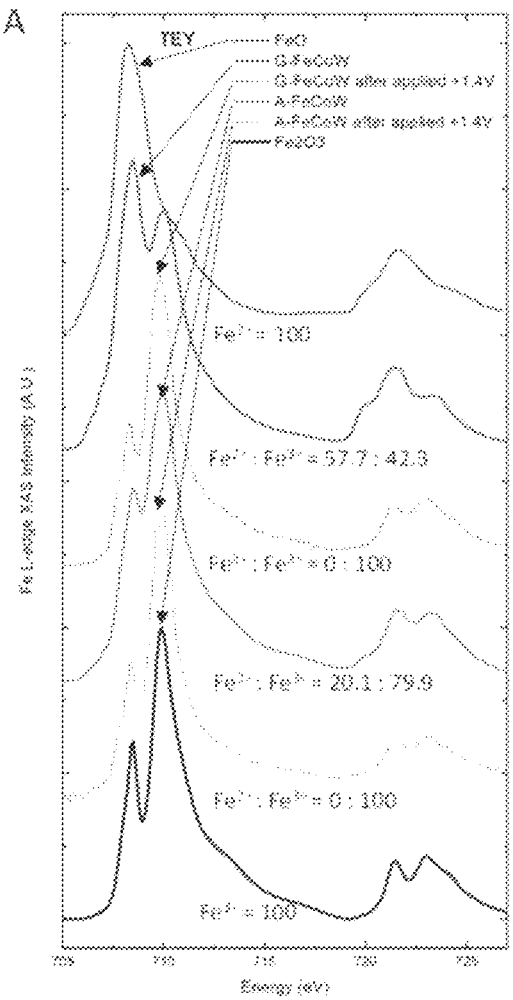
FIGS. 5A-5E. Surface and bulk X-ray absorption spectra of gelled FeCoW (G-FeCoW) oxy-hydroxides catalysts and FeCoW controls after annealing.
Figure 5B:
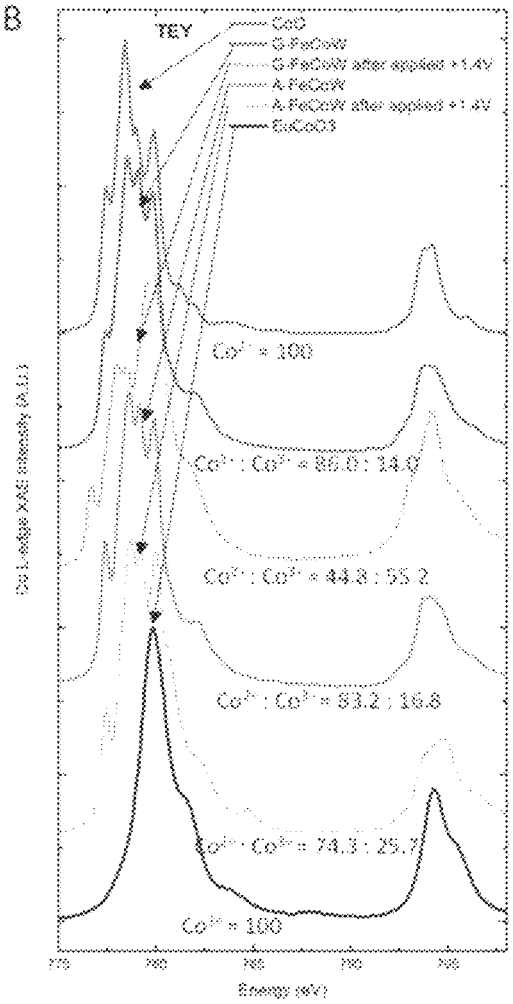
Figure 5C:
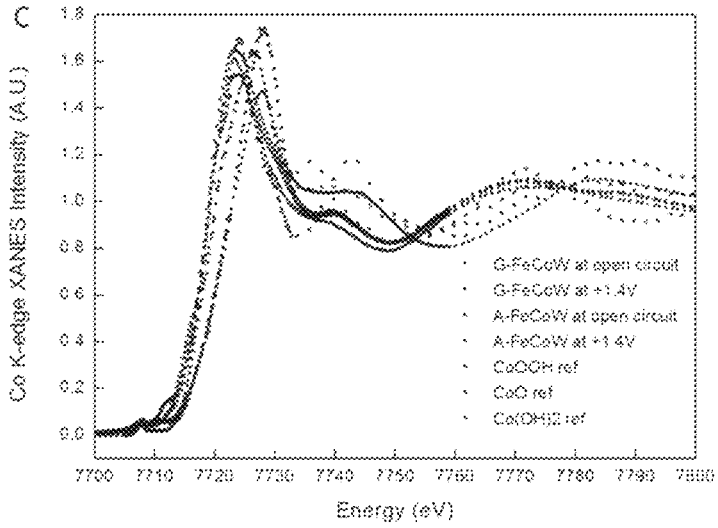
Figure 5D:
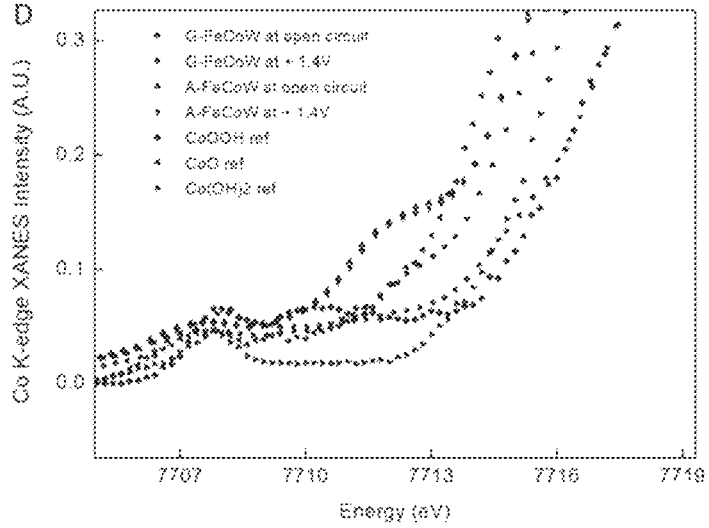

To evaluate the change of oxidation states of metal elements during OER, we performed XAS on G-FeCoW and A-FeCoW samples before and after OER; the latter condition is realized by oxidizing samples at +1.4 V versus the reversible hydrogen electrode (RHE) in the OER region. XAS in total electron yield (TEY) mode provides information on the near-surface chemistry (below 10 nm). We acquired TEY data at the Fe and Co L-edges on samples prepared ex situ. For comparison, on the same samples we also measured in situ XAS (i.e., during OER) at the Fe and Co K-edges via fluorescent yield, a measurement that mainly probes chemical changes in the bulk. TEY XAS spectra in FIG. 5A revealed that the surface $Fe^{2+}$ ions in G-FeCoW had been oxidized to $Fe^{3+}$ at +1.4 V, in agreement with thermodynamic data for Fe. However, the oxidation states of Co in G-FeCoW and A-FeCoW samples were appreciably different at 1.4 V. In G-FeCoW, the valence states of both surface (FIG. 5B) and bulk (FIGS. 5C and 5D) Co were similar to pure $Co^{3+}$, including only a modest admixture with $Co^{2+}$: in particular, the Co—K edge profile closely resembled CoOOH. In contrast, in A-FeCoW (in which W is phase-separated), even after a potential of 1.4 V is applied, the surface (FIG. 5B) and bulk (FIGS. 5C and 5D) manifested a substantially higher $Co^{2+}$ content, consistent with the $Co_3O_4$ and $CoWO_4$ phases.

Figure 5E:
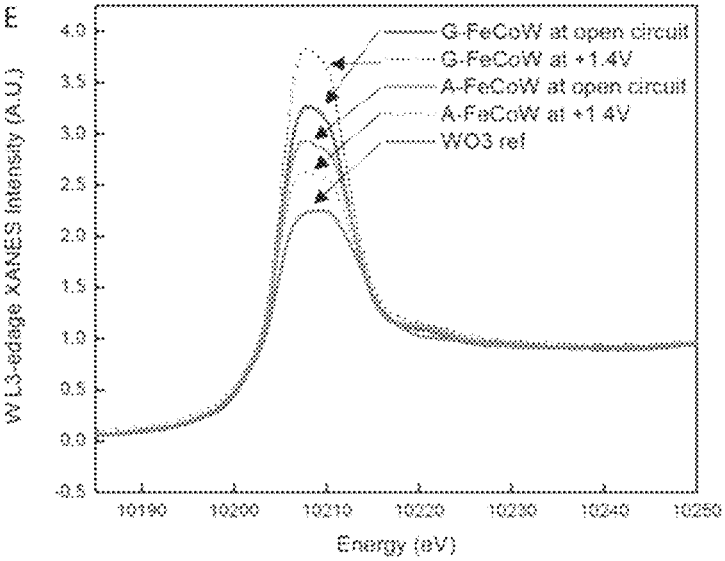

The white lines of W $L_3$-edge XANES spectra of all samples in FIG. 5E show that W in G-FeCoW and A-FeCoW samples before and after OER has a distorted $WO_6$ octahedral symmetry. The W $L_3$ amplitude in pre-OER A-FeCoW was low, a finding attributable to the loss of bound water during annealing. When a +1.4 V bias was applied, the W $L_3$ intensity in G-FeCoW increased, indicating that the valence of W decreases, consistent with increased distortion of $WO_6$ octahedra. These results indicate that Fe and Co also inversely influence W in the homogeneous ternary metal oxy-hydroxides, which may prevent W leaching during operation.

We compared the OER performance of our gelled sample G-FeCoW with that of the reference samples state-of-the-art NiFeOOH and A-FeCoW. Electrochemical measurements were performed using a three-electrode system connected to an electrochemical workstation (Autolab PGSTAT302N) with built-in electrochemical impedance spectroscopy (EIS) analyzer. The working electrode was a Glassy-Carbon Electrode (GCE) (diameter: 3 mm, area: 0.072 $cm^2$) from CH Instruments. Ag/AgCl (with saturated KCl as the filling solution) and platinum foil were used as reference and counter electrodes, respectively. 4 mg of catalyst powder was dispersed in 1 ml mixture of water and ethanol (4:1,v/v), and then 80 μl (microliters) of Nafion solution (5 wt % in water) was added. The suspension was immersed in an ultrasonic bath for 30 min to prepare a homogeneous ink. The working electrode was prepared by depositing 5 μl catalyst ink onto GCE (catalyst loading 0.21 mg $cm^{-2}$). To load the catalyst on a Ni foam (thickness: 1.6 mm, Sigma) for stability measurements, 20 mg of catalyst was dispersed in a mixture containing 2 ml of water and 2 ml ethanol, followed by the addition of 100 μL Nafion solution. The suspension was sonicated for 30 min to prepare a homogeneous ink. Ni foam with a fixed area of 0.5×0.5 $cm^2$ coated with water resistant silicone glue was drop-casted with 20 μL of the catalyst ink.

Representative OER currents of the samples were measured for drop-casted thin films (thickness ~500 nm) on a glass carbon electrode (GCE) (FIG. 6A) in 1 M KOH aqueous electrolyte (pH=13.6) at a scan rate of 1 mV $s^{-1}$ (currents are uncorrected and thus include the effects of resistive losses incurred within the electrolyte). The G-FeCoW-on-GCE electrode requiring an overpotential of 223 mV at 10 mA $cm^{-2}$. Without carbon additives, and without iR corrections, the G-FeCoW catalyst consistently outperforms the best oxide catalysts previously reported. This potential is 63 mV lower than that of the state-of-the-art NiFeOOH. When the gelled sample was subjected to a postsynthetic thermal treatment (500° C. anneal), the overpotential of the FeCoW electrode increased to 301 mV at 10 mA $cm^{-2}$.

The intrinsic activity of G-FeCoW was further confirmed by determining the mass activities and turnover frequency (TOFs) for this catalyst (FIG. 6B). We used data obtained on GCE with 95% iR correction at η=300 mV (Note: unless otherwise stated, remaining data in this work are not corrected by 95% iR). As shown in FIG. 6B and Table 1, the G-FeCoW catalysts on GCE exhibit TOFs of 0.46 $s^{-1}$ per total 3d metal atoms and mass activities of 1175 A $g^{-1}$ (considering the total loading mass on the lower limiting case). If only considering electrochemically active 3d metals or mass (obtained from the integration of Co redox features), G-FeCoW catalysts exhibit a much higher TOFs of 1.5 $s^{-1}$ and 3500 A $g^{-1}$. These are >three times above the TOF and mass activities of the optimized control catalysts and the repeated the state-of-art NiFeOOH.

TABLE 1

| Samples | Overpotential (mV)[a] | Bulk TOFs ($S^{-1}$)[b] | Electrochemically active TOFs ($S^{-1}$)[b] | Bulk mass activity (A $g^{-1}$)[c] | Electrochemically active mass activity (A $g^{-1}$)[c] |
|---|---|---|---|---|---|
| Gelled FeCoW (0.21 mg $cm^{-2}$) | 223 (−/+2) | 0.46 (−/+0.08) | 1.5 (−/+0.2)[d] | 1175 (−/+80) | 3500 (−/+200)[d] |
| Repeated NiFe (0.21 mg $cm^{-2}$) | 286 (− +3) | 0.07 (−/+0.01) | 0.33 (−/+0.1) | 117 (−/+30) | 940 (−/+150) |
| State-of-the-art NiFe (below 0.1 mg $cm^{-2}$) | 258 ref. (12) | 0.1 ref. (13, 14) | 0.4 ref. (12) | 320[e] | 1818[e] |

[a]obtained from at the current density of 10 mA $cm^{-2}$ with no iR correction;
[b]obtained at the overpotential of 300 mV with 95% iR correction, assuming 3d metals as active sites;
[c]obtained at the overpotential of 300 mV with 95% iR correction;
[d]the active numbers of 3d metals were obtained from the integration of Co redox features and molar ratio of Fe and Co;
[e]calculated from the reported data in ref. (13, 14) and (12).

The operating stability of the OER catalysts is essential to their application. To characterize the performance stability of the G-FeCoW catalysts, we ran water oxidation on the catalyst deposited on gold-plated Ni foam under constant current of 30 mA $cm^{-2}$ continuously for 550 hours. We observed no appreciable increase in potential in this time interval (FIGS. 6C, D). To check that the catalyst remained physically intact, we tested in situ its mass using the electrochemical crystal microbalance (EQCM) technique, and also assessed whether any metal had leached into the electrolyte using inductively coupled plasma atomic emission spectroscopy (ICP-AES). Following the completion of an initial burn-in period in which (presumably unbound) W is shed into the electrolyte, we saw stable operation, and no discernible W loss. By measuring the $O_2$ evolved from the G-FeCoW/gold-plated Ni foam catalyst, we also confirmed the high activity throughout the entire duration of stability test, obtaining quantitative (i.e. unity Faradaic efficiency) gas evolution of $O_2$ to within our available +/−5% experimental error (FIG. 6D). These findings suggest that modulating the 3d transition in metal oxy-hydroxides using a suitable transition metal, one closely atomically coupled through homogeneous solid-state dispersion, may provide further avenues to OER optimization.

Example 2

Preparation of FeCoMo Oxy-Hydroxides

Figure 7:
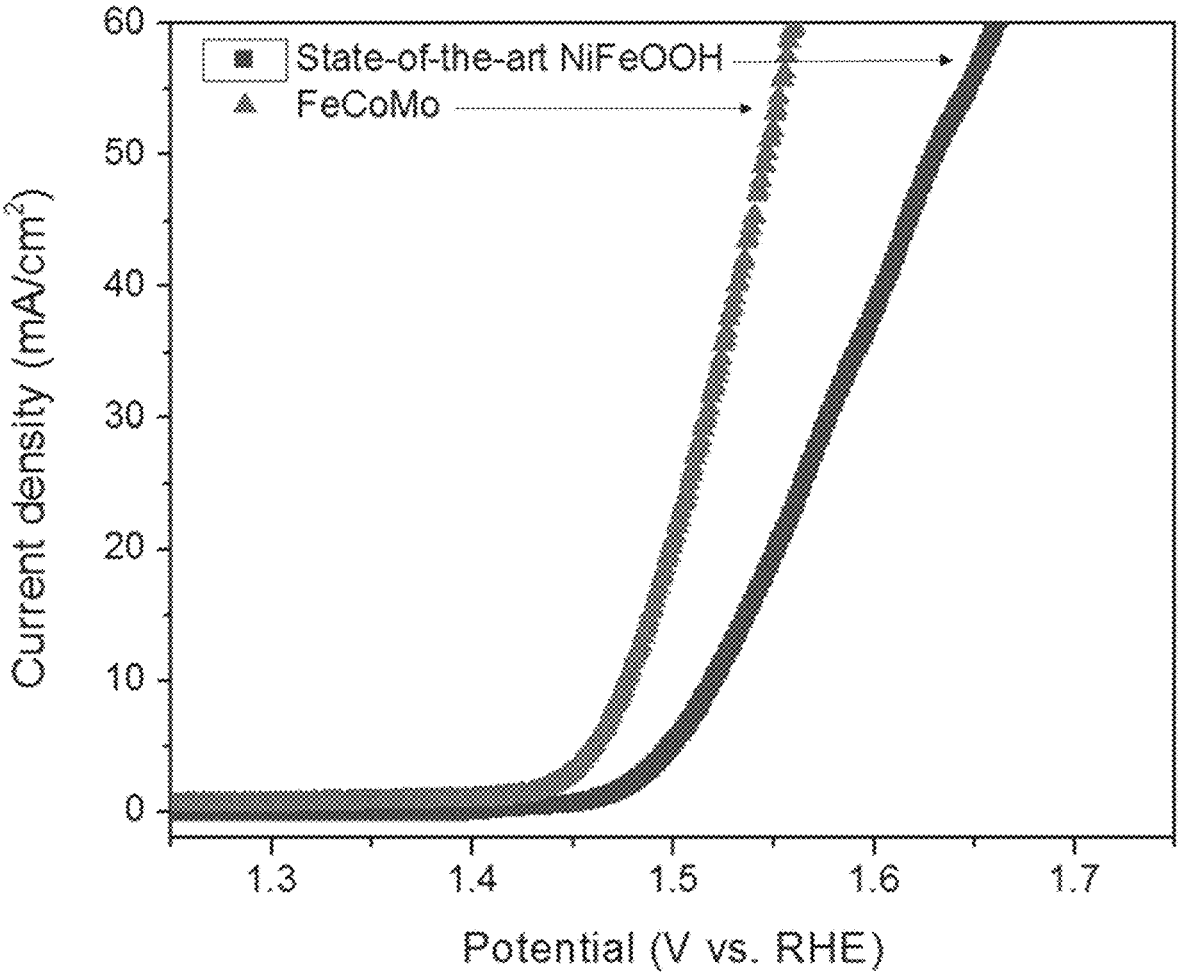
FIG. 7. Performance of gelled FeCoMo (G-FeCoMo) oxy-hydroxide catalysts and controls in three-electrode configuration in 1 M KOH aqueous electrolyte. The OER polarization curve of catalysts loaded on glass carbon electrodes with 1 mV $s^{-1}$ scan rate, without iR-correction.

In this example, the steps of synthesis were identical to Example 1 except for changing the metal salts as precursors and the amount of water. Anhydrous $FeCl_3$ (0.9 mmol), $CoCl_2$ (0.9 mmol) and $MoCl_5$ (0.9 mmol) were first dissolved in ethanol (2 mL) in a vial. A solution of deionized water (DI) (0.17 mL) in ethanol (2 mL) was prepared in a separate vial. The steps of preparing electrodes for performance measurements and testing process were identical to Example 1. As shown in FIG. 7 and Table 2, the FeCoMo-on-GCE electrode requiring an overpotential of 246 mV at 10 mA $cm^{-2}$, which is 40 mV lower than that of the state-of-the-art NiFeOOH.

TABLE 2

| Samples | Overpotential at 10 mA/$cm^2$ |
|---|---|
| State-of-the-art NiFe | 286 mV |
| NiFeMn | 271 mV |
| NiFeSb | 260 mV |
| NiFeBa | 260 mV |
| NiFeRe | 213 mV |
| NiFeIr | 212 mV |
| FeCoW | 223 mV |
| FeCoMo | 240 mV |
| FeCoMoW | 211 mV |
| FeCoCr | 278 mV |
| FeNiCoP | 330 mV[a] |

[a]tested in $CO_2$-saturated 0.5M $KHCO_3$ on gold foam

Example 3

Preparation of FeCoMoW Oxy-Hydroxides

Figure 8:
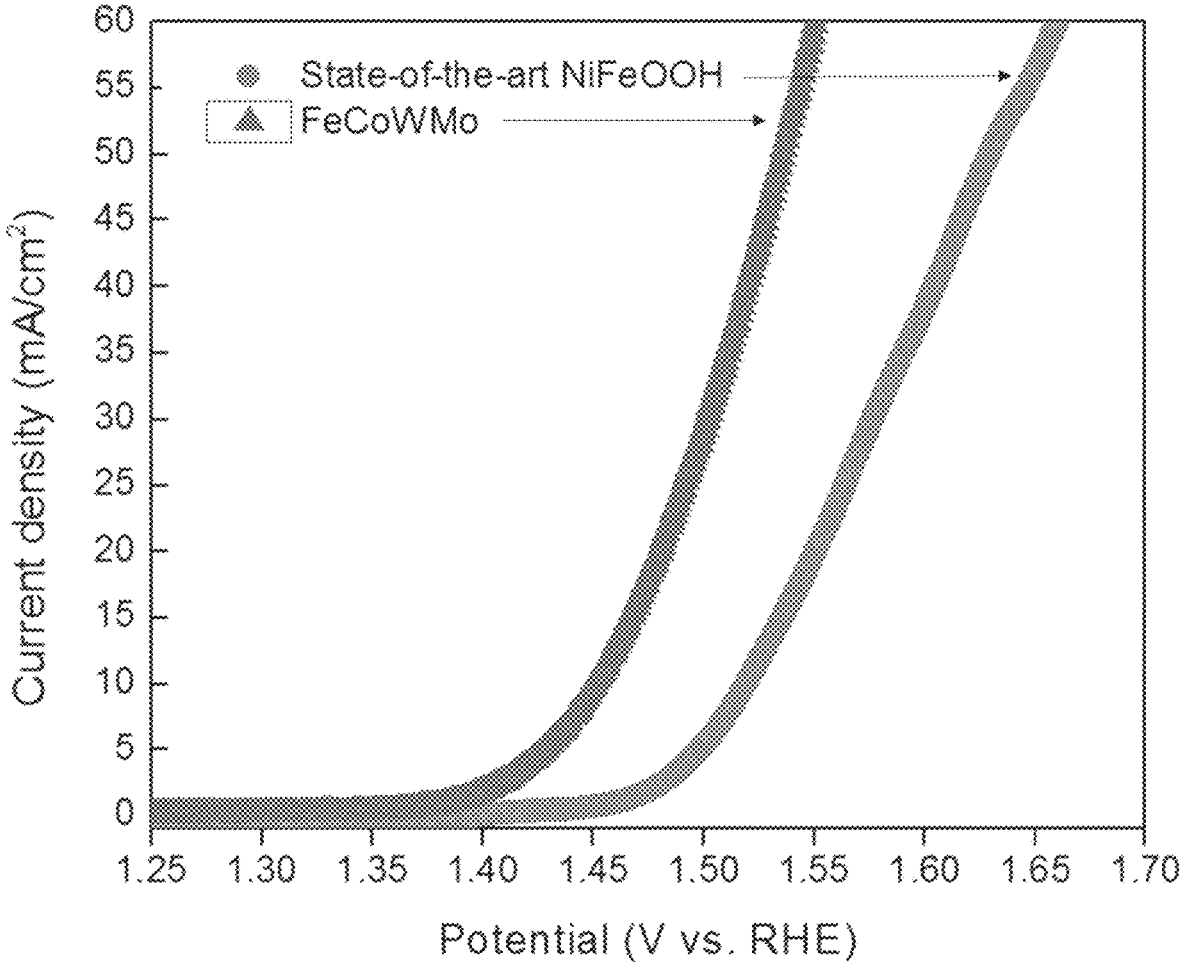
FIG. 8. Performance of gelled FeCoWMo (G-FeCoWMo) oxy-hydroxide catalysts and controls in three-electrode configuration in 1 M KOH aqueous electrolyte. The OER polarization curve of catalysts loaded on glass carbon electrodes with 1 mV $s^{-1}$ scan rate, without iR-correction.

In this example, the steps of synthesis were identical to Example 1 except for changing the metal salts as precursors and the amount of water. Anhydrous $FeCl_3$ (0.7 mmol), $CoCl_2$ (0.7 mmol), $WCl_6$ (0.7 mmol) and $MoCl_5$ (0.7 mmol) were first dissolved in ethanol (2 mL) in a vial. A solution of deionized water (DI) (0.21 mL) in ethanol (2 mL) was prepared in a separate vial. The steps of preparing electrodes for performance measurements and testing process were identical to Example 1. As shown in FIG. 8, the FeCoMoW-on-GCE electrode requiring an overpotential of 220 mV at 10 mA $cm^{-2}$, which is 66 mV lower than that of the state-of-the-art NiFeOOH. As shown in FIG. 8 and Table 2, the FeCoMoW-on-GCE electrode requiring an overpotential of 211 mV at 10 mA $cm^{-2}$, which is 75 mV lower than that of the state-of-the-art NiFeOOH.

Example 4

Preparation of FeCoCr Oxy-Hydroxides

Figure 9:
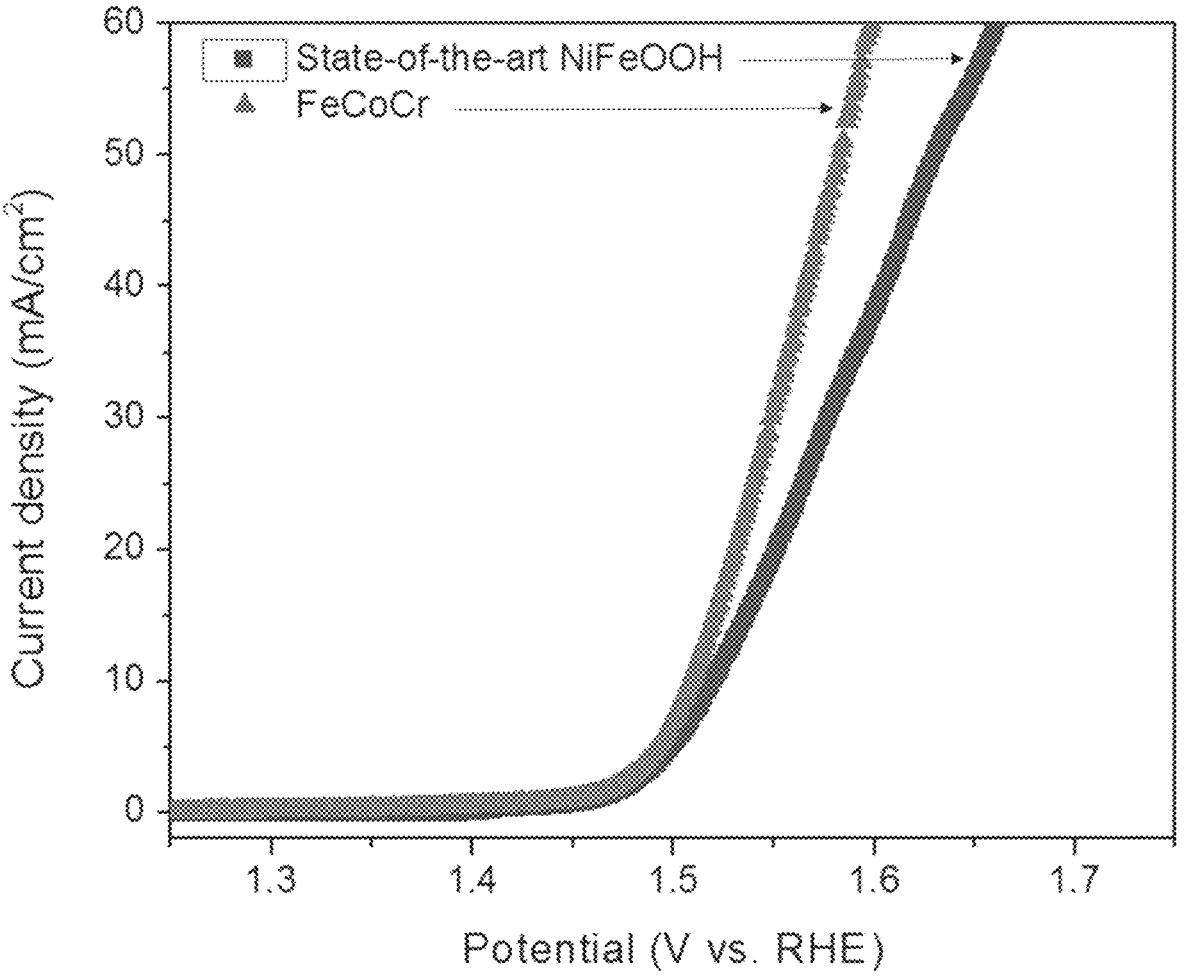
FIG. 9. Performance of gelled FeCoCr (G-FeCoCr) oxy-hydroxide catalysts and controls in three-electrode configuration in 1 M KOH aqueous electrolyte. The OER polarization curve of catalysts loaded on glass carbon electrodes with 1 mV $s^{-1}$ scan rate, without iR-correction.

In this example, the steps of synthesis were identical to Example 1 except for changing the metal salts as precursors and the amount of water. Anhydrous $FeCl_3$ (0.9 mmol), $CoCl_2$ (0.9 mmol), and $CrCl_3.6H_2O$ (0.9 mmol) were first dissolved in ethanol (2 mL) in a vial. A solution of deionized water (DI) (0.04 mL) in ethanol (2 mL) was prepared in a separate vial. The steps of preparing electrodes for performance measurements and testing process were identical to Example 1. As shown in FIG. 9 and Table 2, the FeCoCr-on-GCE electrode requiring an overpotential of 278 mV at 10 mA $cm^{-2}$, which is 8 mV lower than that of the state-of-the-art NiFeOOH.

Example 5

Preparation of FeNiSb Oxy-Hydroxides

Figure 10:
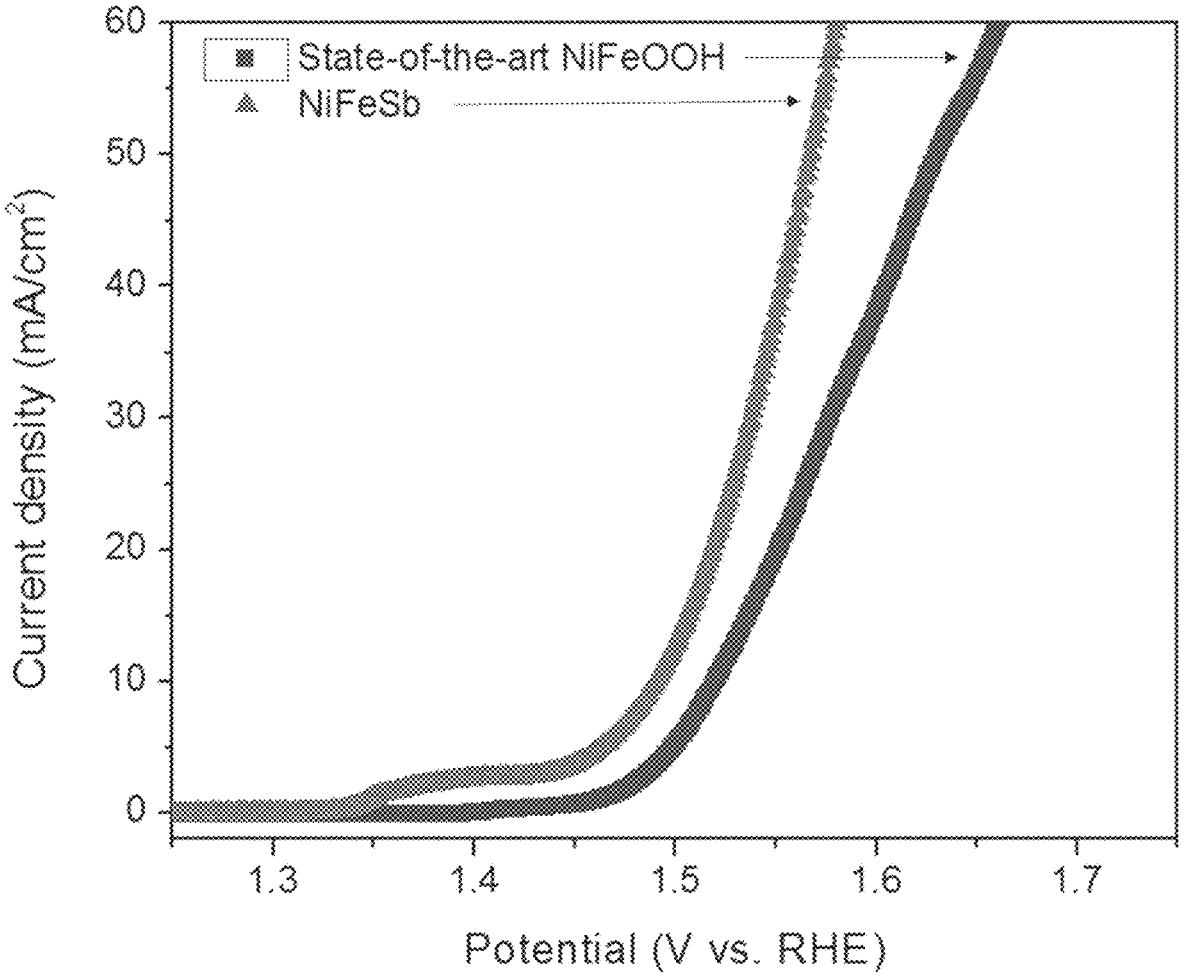
FIG. 10. Performance of gelled FeNiSb (G-FeNiSb) oxy-hydroxide catalysts and controls in three-electrode configuration in 1 M KOH aqueous electrolyte. The OER polarization curve of catalysts loaded on glass carbon electrodes with 1 mV $s^{-1}$ scan rate, without iR-correction.

In this example, the steps of synthesis were identical to Example 1 except for changing the metal salts as precursors and the amount of water. Anhydrous $FeCl_3$ (0.28 mmol), $NiCl_2.6H_2O$ (2.45 mmol) were first dissolved in ethanol (2 mL) in a vial. A solution of $SbCl_3$ (0.27 mmol) dissolved in ethanol (2 mL) was prepared in a separate vial. No additional water was needed. After chilling, the two solutions mixed quickly, and propylene oxide (≈1 mL) was then slowly added, forming a gel. The steps of preparing electrodes for performance measurements and testing process were identical to Example 1. As shown in FIG. 10 and Table 2, the FeNiSb-on-GCE electrode requiring an overpotential of 260 mV at 10 mA $cm^{-2}$, which is 26 mV lower than that of the state-of-the-art NiFeOOH.

Example 6

Preparation of FeNiMn Oxy-Hydroxides

Figure 11:
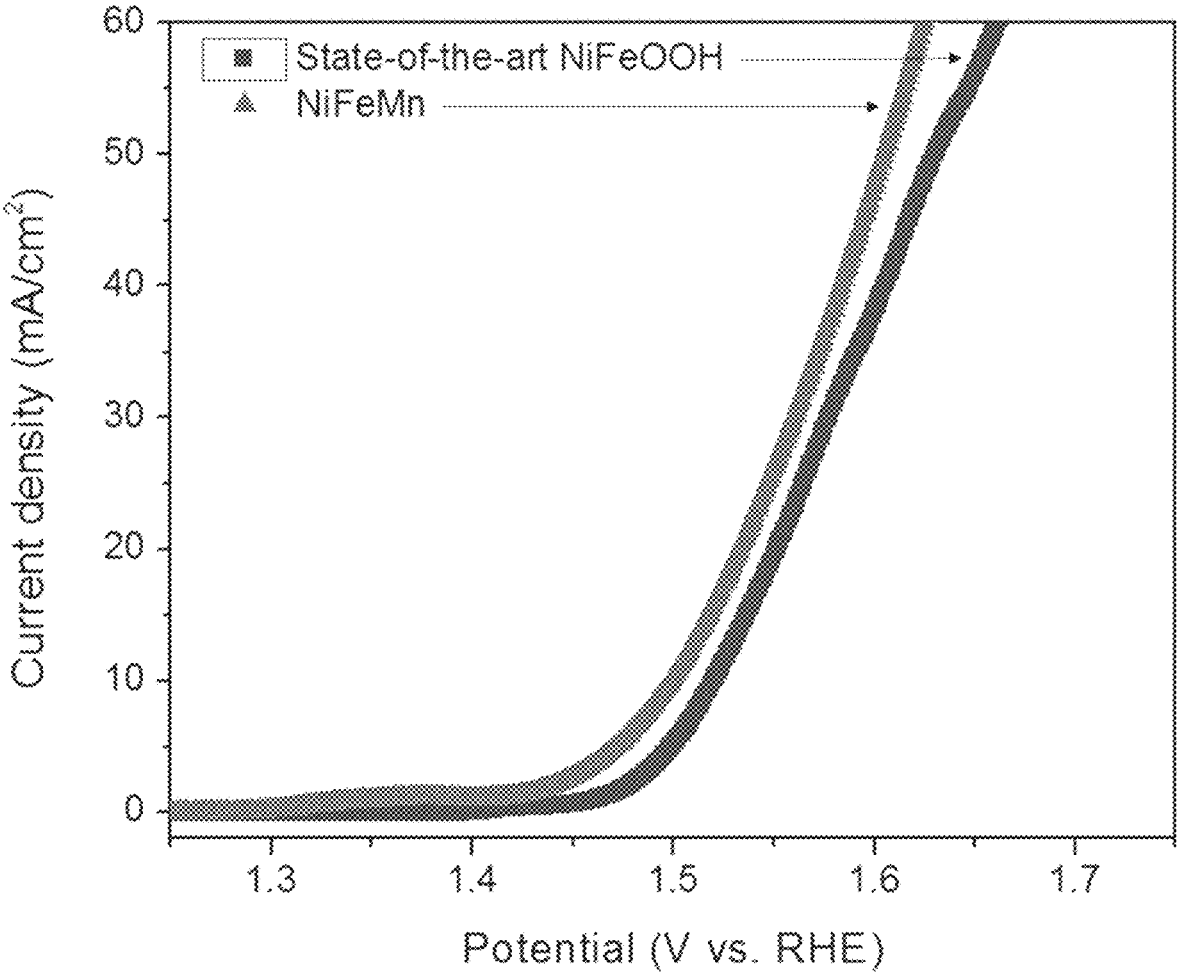
FIG. 11. Performance of gelled FeNiMn (G-FeNiMn) oxy-hydroxide catalysts and controls in three-electrode configuration in 1 M KOH aqueous electrolyte. The OER polarization curve of catalysts loaded on glass carbon electrodes with 1 mV $s^{-1}$ scan rate, without iR-correction FIG. 12. Performance of gelled FeNiBa (G-FeNiBa) oxy-hydroxide catalysts and controls in three-electrode configuration in 1 M KOH aqueous electrolyte. The OER polarization curve of catalysts loaded on glass carbon electrodes with 1 mV $s^{-1}$ scan rate, without iR-correction.

In this example, the steps of synthesis were identical to Example 1 except for changing the metal salts as precursors and the amount of water. Anhydrous $FeCl_3$ (0.28 mmol), $NiCl_2.6H_2O$ (2.45 mmol) and $MnCl_2$ (0.28 mmol) were first dissolved in ethanol (4 mL) in a vial. No additional water was needed. The solution mentioned above was cooled in an ice bath for 2 h in order to prevent uncontrolled hydrolysis and condensation which may lead to the formation of precipitate rather than gel formation. To this solution, propylene oxide (≈1 mL) was then slowly added, forming a gel. The steps of preparing electrodes for performance measurements and testing process were identical to Example 1. As shown in FIG. 11 and Table 2, the FeNiMn-on-GCE electrode requiring an overpotential of 271 mV at 10 mA $cm^{-2}$, which is 15 mV lower than that of the state-of-the-art NiFeOOH.

Example 7

Preparation of FeNiBa Oxy-Hydroxides

Figure 12:
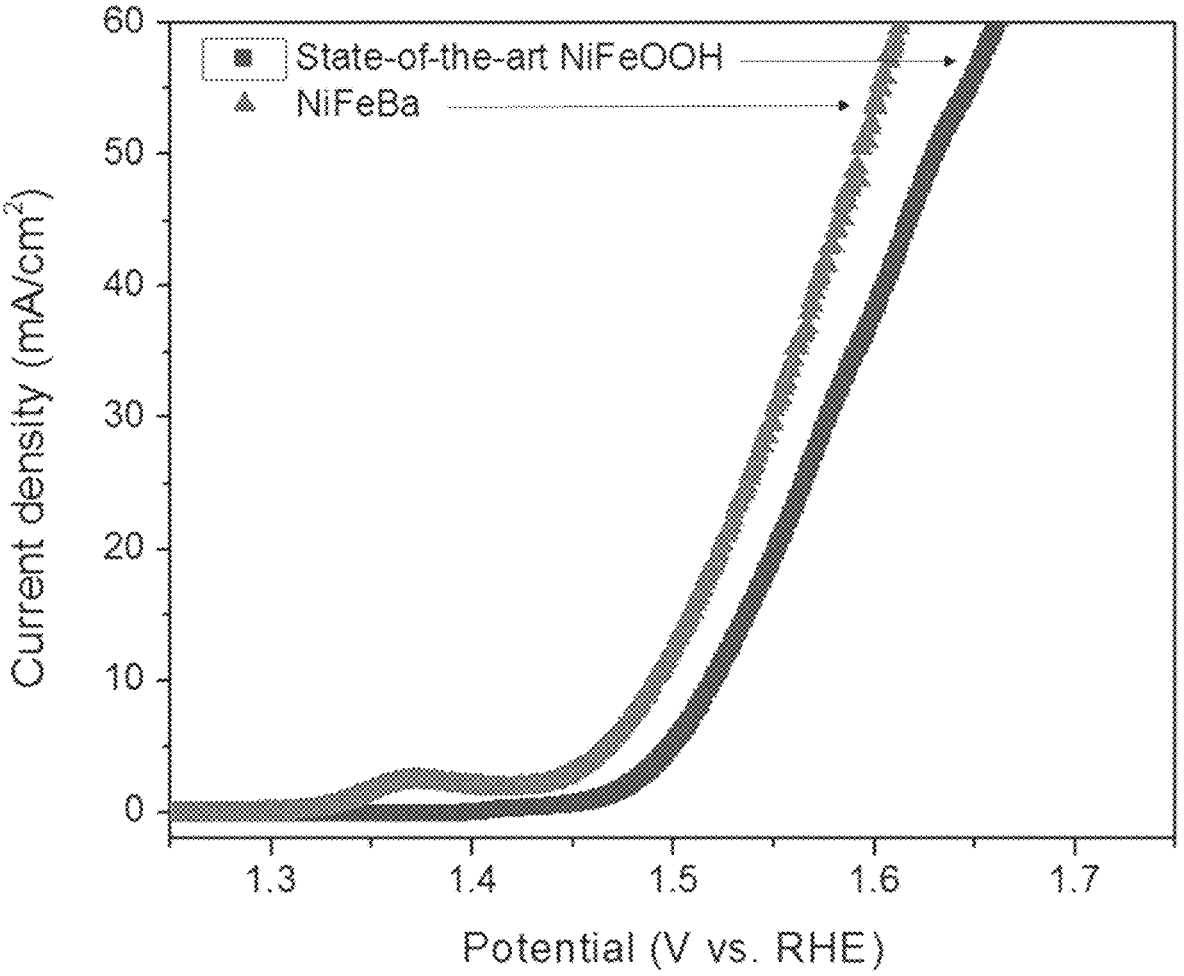

In this example, the steps of synthesis were identical to Example 1 except for changing the metal salts as precursors and the amount of water. Anhydrous $FeCl_3$ (0.28 mmol), $NiCl_2.6H_2O$ (2.45 mmol) were first dissolved in ethanol (2 mL) in a vial. A solution of $BaF_2$ (0.28 mmol) dissolved in ethanol (2 mL) was prepared in a separate vial. No additional water was needed. The solution mentioned above was cooled in an ice bath for 2 h in order to prevent uncontrolled hydrolysis and condensation which may lead to the formation of precipitate rather than gel formation. The two solutions mixed quickly, and propylene oxide (≈1 mL) was then slowly added, forming a gel. The steps of preparing electrodes for performance measurements and testing process were identical to Example 1. As shown in FIG. 12 and Table 2, the FeNiBa-on-GCE electrode requiring an overpotential of 260 mV at 10 mA $cm^{-2}$, which is 26 mV lower than that of the state-of-the-art NiFeOOH.

Example 8

Preparation of FeNiRe Oxy-Hydroxides

Figure 13:
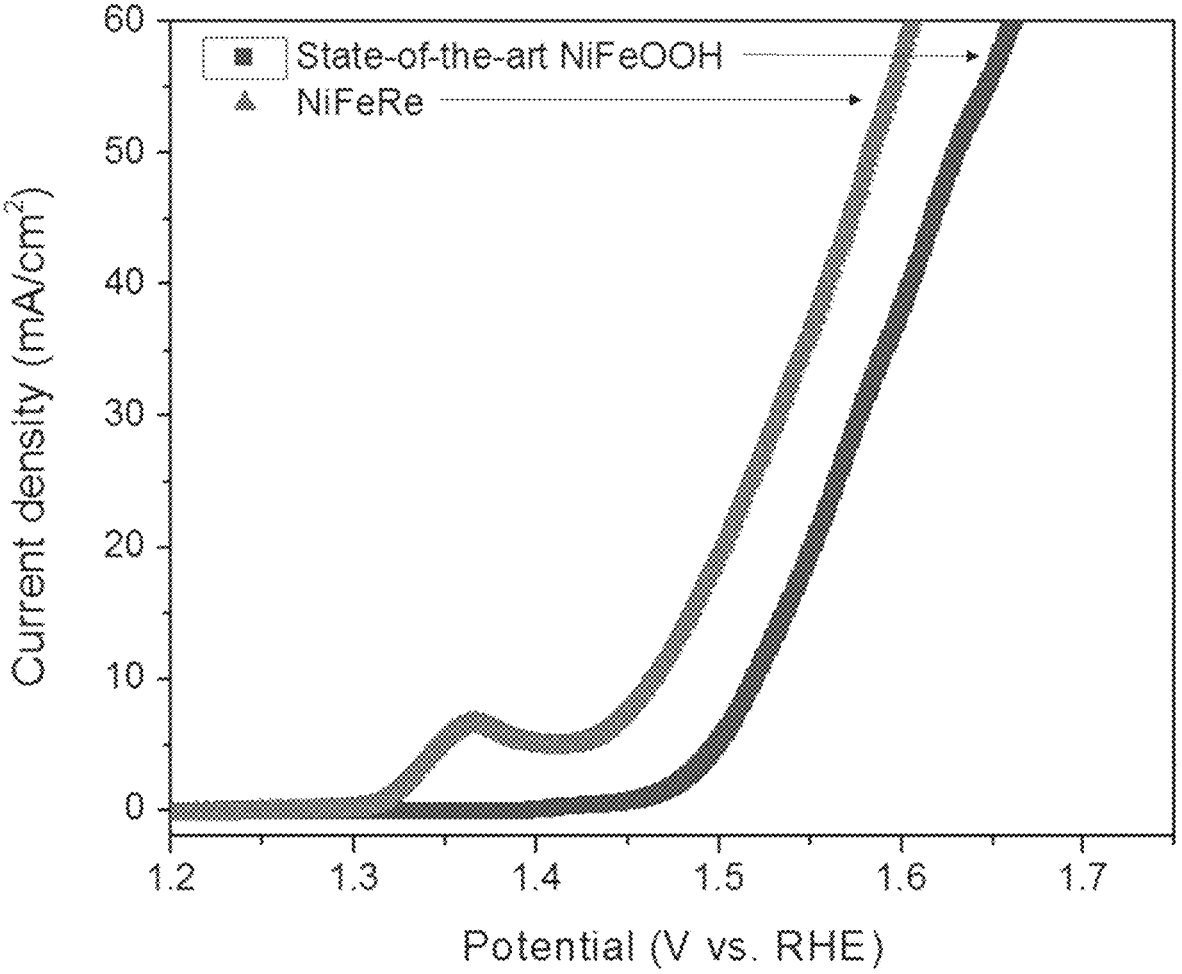
FIG. 13. Performance of gelled FeNiRe (G-FeNiRe) oxy-hydroxide catalysts and controls in three-electrode configuration in 1 M KOH aqueous electrolyte. The OER polarization curve of catalysts loaded on glass carbon electrodes with 1 mV $s^{-1}$ scan rate, without iR-correction.

In this example, the steps of synthesis were identical to Example 1 except for changing the metal salts as precursors and the amount of water. Anhydrous $FeCl_3$ (0.28 mmol), $NiCl_2.6H_2O$ (2.45 mmol) were first dissolved in ethanol (2 mL) in a vial. A solution of $ReCl_5$ (0.28 mmol) dissolved in ethanol (2 mL) was prepared in a separate vial. No additional water was needed. The solution mentioned above was cooled in an ice bath for 2 h in order to prevent uncontrolled hydrolysis and condensation which may lead to the formation of precipitate rather than gel formation. The two solutions mixed quickly, and propylene oxide (≈1 mL) was then slowly added, forming a gel. The steps of preparing electrodes for performance measurements and testing process were identical to Example 1. As shown in FIG. 13 and Table 2, the FeNiRe-on-GCE electrode requiring an overpotential of 213 mV at 10 mA $cm^{-2}$, which is 73 mV lower than that of the state-of-the-art NiFeOOH.

Example 9

Preparation of FeNiIr Oxy-Hydroxides

Figure 14:
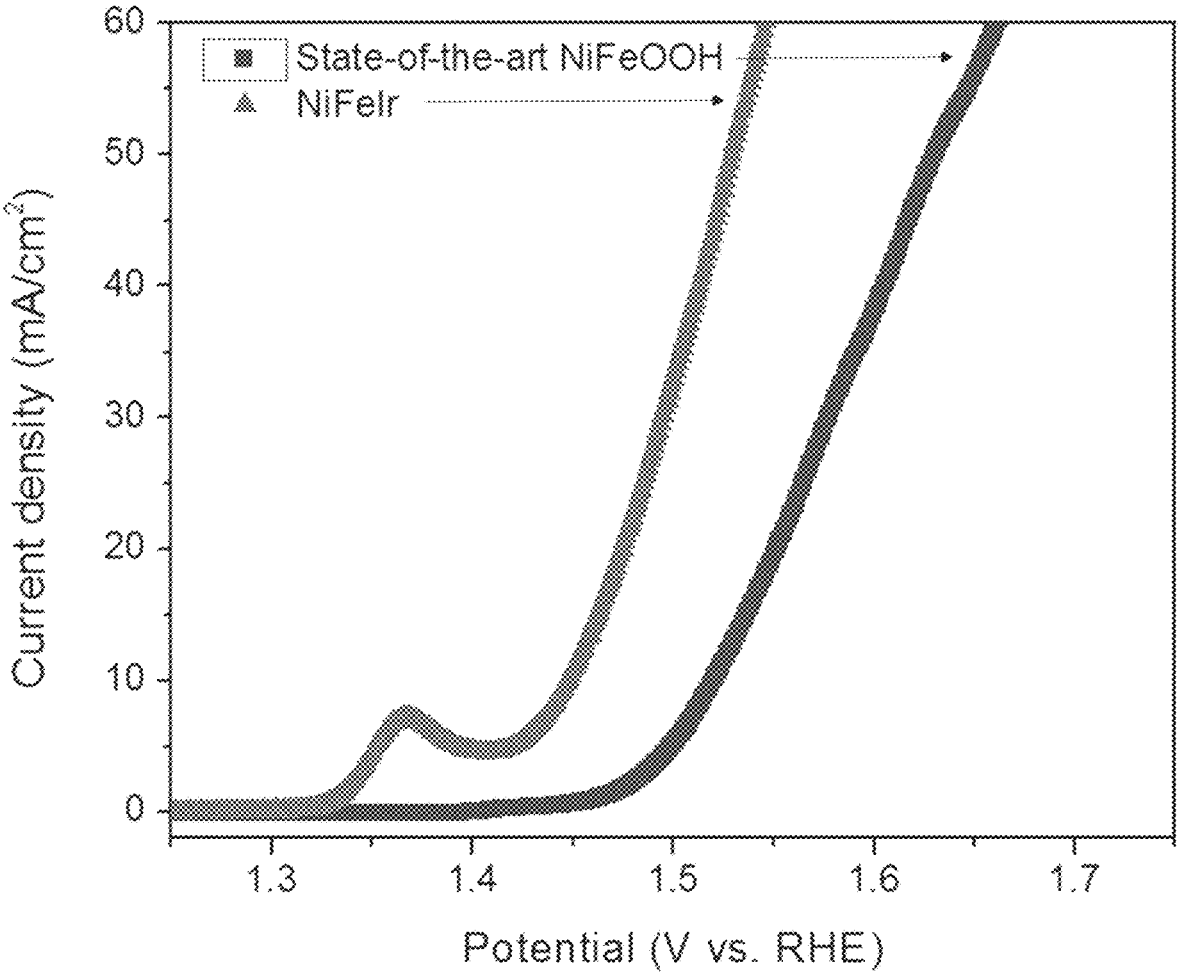
FIG. 14. Performance of gelled FeNiIr (G-FeNiIr) oxy-hydroxide catalysts and controls in three-electrode configuration in 1 M KOH aqueous electrolyte. The OER polarization curve of catalysts loaded on glass carbon electrodes with 1 mV $s^{-1}$ scan rate, without iR-correction.

In this example, the steps of synthesis were identical to Example 1 except for changing the metal salts as precursors and the amount of water. Anhydrous $FeCl_3$ (0.28 mmol), $NiCl_2.6H_2O$ (2.45 mmol) were first dissolved in ethanol (2 mL) in a vial. A solution of $IrCl_3$ (0.28 mmol) dissolved in ethanol (2 mL) was prepared in a separate vial. No additional water was needed. The solution mentioned above was cooled in an ice bath for 2 h in order to prevent uncontrolled hydrolysis and condensation which may lead to the formation of precipitate rather than gel formation. The two solutions mixed quickly, and propylene oxide (≈1 mL) was then slowly added, forming a gel. The steps of preparing electrodes for performance measurements and testing process were identical to Example 1. As shown in FIG. 14 and Table 2, the FeNiIr-on-GCE electrode requiring an overpotential of 212 mV at 10 mA $cm^{-2}$, which is 74 mV lower than that of the state-of-the-art NiFeOOH.

Example 10

Preparation of FeNiCoP Oxy-Hydroxides

Figure 15:
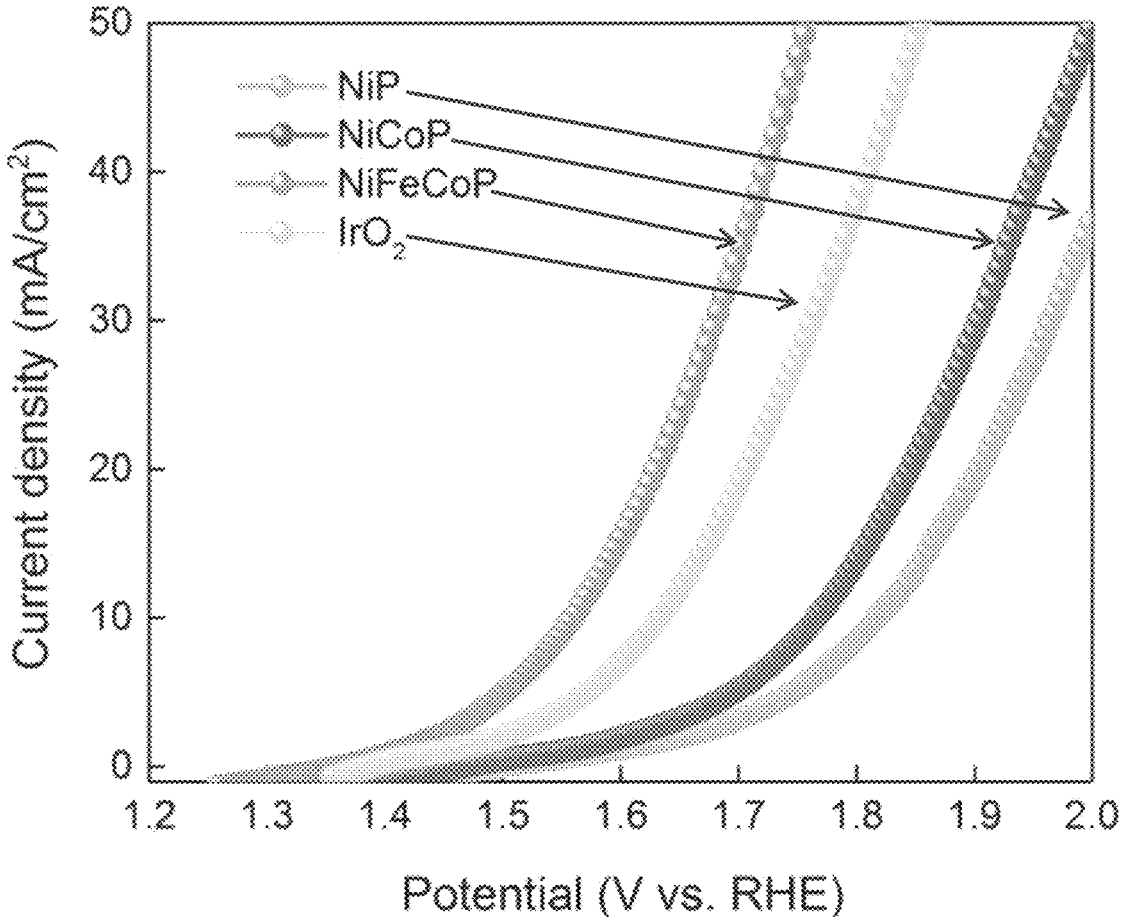
FIG. 15. Performance of gelled FeNiCoP, NiCoP, NiP oxy-hydroxide catalysts prepared using the proposed method vs. state-of-the-art $IrO_2$ control in a three-electrode configuration in $CO_2$-saturated 0.5 M $KHCO_3$ aqueous electrolyte (pH 7.2).

In this example, the steps of synthesis were identical to Example 1 except for changing the metal salts as precursors and the amount of water. Anhydrous $FeCl_3$ (0.27 mmol), $NiCl_2.6H_2O$ (2.45 mmol) and $CoCl_2$ (0.27 mmol) were first dissolved in ethanol (2 mL) in a vial. A solution of $KH_2PO4$ (0.27 mmol) dissolved in ethanol (2 mL) mixed with deionized water (DI) (0.23 ml) was prepared in a separate vial. The solution mentioned above was cooled in an ice bath for 2 h in order to prevent uncontrolled hydrolysis and condensation which may lead to the formation of precipitate rather than gel formation. The two solutions mixed quickly, and propylene oxide (≈1 mL) was then slowly added, forming a gel. The steps of preparing electrodes for performance measurements and testing process were identical to Example 1, except that the electrolyte was changed into $CO_2$-saturated 0.5 M $KHCO_3$. As shown in FIG. 15 and Table 2, the FeNiCoP-on-gold foam electrode requiring an overpotential of 330 mV at 10 mA $cm^{-2}$, which is 130 mV lower than that of the state-of-the-art $IrO_2$, tested in $CO_2$-saturated 0.5 M $KHCO_3$.

Example 11

Preparation of CuCe Oxy-Hydroxide and its Electrochemical Reduction

Figure 16A:
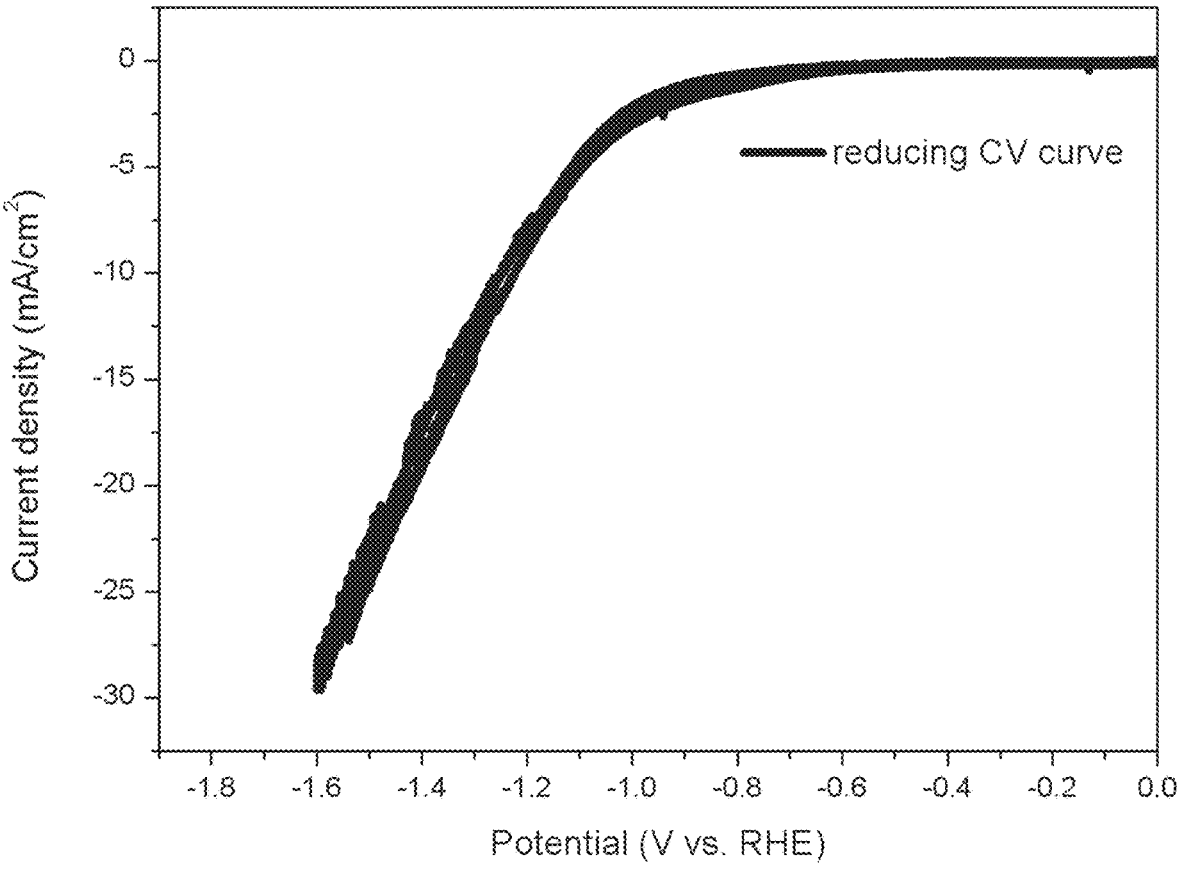
FIGS. 16A-16B. Performance of gelled CuCe oxy-hydroxide, after electrochemical reduction, operating as $CO_2$ reduction catalyst in three-electrode configuration in CO2-saturated 0.5 M $KHCO_3$ aqueous electrolyte (pH 7.2)
Figure 16B:
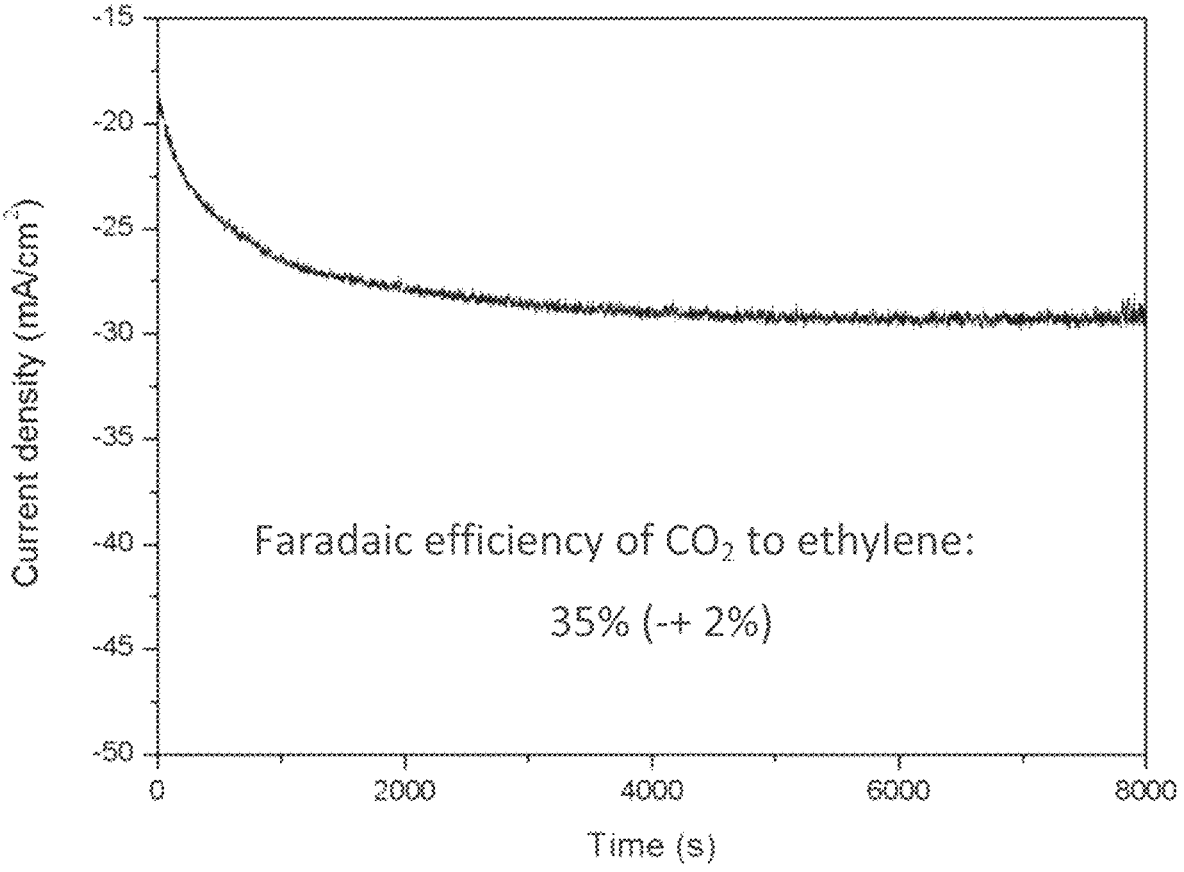

In this example, the steps of synthesis were identical to Example 1 except for changing the metal salts as precursors and the amount of water. Anhydrous $CuCl_2$ (2.45 mmol), and $CeCl_3$ (0.27 mmol) were first dissolved in ethanol (2 mL) in a vial. A solution of ethanol (2 mL) mixed with deionized water (DI) (0.11 ml) was prepared in a separate vial. The solution mentioned above was cooled in an ice bath for 2 h in order to prevent uncontrolled hydrolysis and condensation which may lead to the formation of precipitate rather than gel formation. The two solutions mixed quickly, and propylene oxide (≈1 mL) was then slowly added, forming a gel. The steps of preparing electrodes for performance measurements and testing system were identical to Example 1. To reduce our CuCe oxy-hydroxide into alloys, the working electrodes were run under cyclic voltammetric technique between −0.6V and −2.2V (vs. Ag/AgCl reference electrode) for three cycles, with a scanning rate of 50 mV/s. As shown in FIG. 16, the selectivity of $C_2H_4$ can reach to 34%, tested in $CO_2$-saturated 0.5 M $KHCO_3$.

Summary of Non-Limiting Exemplary Oxygen Evolution Electrodes

An embodiment of an oxygen evolution electrode includes a conductive substrate and a homogeneously dispersed multimetal oxy-hydroxide catalyst coated on the conductive substrate. The homogeneously dispersed multimetal oxy-hydroxide catalyst comprises at least iron (Fe), cobalt (Co) and tungsten (W), a ratio of the Fe:Co:W being about 1:X:Y, where X ranges from about 0.1 to about 10, Y ranges from about 0.001 to about 10. In an embodiment of a 02 evolution electrode, a preferred ratio of Fe:Co:W is about 1:1:0.7.

In another embodiment, the electrode may include molybdenum, with a ratio of the Fe:Co:W:Mo being about 1:X:Y:Z, wherein X ranges from about 0.1 to about 10, Y ranges from about 0.001 to about 10, and Z ranges from about 0.001 to about 10. In an embodiment of a 02 evolution electrode, a preferred ratio of the Fe:Co:W:Mo is about 1:1:0.5:0.5.

Another oxygen evolution electrode includes at least iron (Fe), cobalt (Co) and molybdenum (Mo), a ratio of the Fe:Co:Mo being about 1:X:Y, where X ranges from about 0.1 to about 10, and Y ranges from about 0.001 to about 10. In a more preferred electrode X ranges from about 0.9 to about 1.1, Y ranges from about 0.6 to about 0.9.

Another oxygen evolution electrode includes at least iron (Fe), cobalt (Co), nickel (Ni), and phosphorus (P), a ratio of the Fe:Co:Ni:P being about 1:X:Y:Z, where X ranges from about 0.1 to about 10, Y ranges from about 1 to about 100, and Z ranges from about 0.001 to about 10. In a more preferred electrode X ranges from about 0.9 to about 1.1, Y ranges from about 8 to about 10, and Z ranges from about 0.05 to about 0.2.

Another oxygen evolution electrode includes at least iron (Fe), cobalt (Co), nickel (Ni), and boron (B), a ratio of the Fe:Co:Ni:B being about 1:X:Y:Z, where X ranges from about 0.1 to about 10, Y ranges from about 1 to about 100, and Z ranges from about 0.001 to about 10. In a more preferred electrode X ranges from about 0.9 to about 1.1, Y ranges from about 8 to about 10, Z ranges from about 0.05 to about 0.2.

Another oxygen evolution electrode includes at least iron (Fe), nickel (Ni), and magnesium (Mg), a ratio of the Fe:Ni:Mg being about 1:X:Y, where X ranges from about 1 to about 100, and Y ranges from about 0.001 to about 10. In a more preferred electrode X ranges from about 4 to about 8, Y ranges from about 0.4 to about 0.8. In another preferred electrode X is 6, and Y is 0.6.

CONCLUSION

The present disclosure provides substantially homogeneously dispersed multimetal oxy-hydroxide catalyst comprising at least two metals, at least one metal being a transition metal, and at least one additional metal which is structurally dissimilar to at least one metal in the mixture, such that the multimetal oxy-hydroxide is characterized by being substantially homogeneously dispersed and generally not crystalline. A key feature of the present materials is that the presence of the structurally dissimilar metal results in sufficient strain produced in the final multimetal oxy-hydroxide material to prevent crystallization from occurring. The resulting materials are specifically not annealed at temperatures that would induce crystallization in order to avoid the expected phase segregation that would occur during crystallization.

Particular embodiments include the transition metal being any one of Ni, Fe, Co, Mn, Ti, Cu and Zn, and at least a second element being any one of W, Mo, Mn, Cr, Ba, Sb, Bi, Sn, Pb, Ce, Mg, Ir, Re, B and P.

Put another way, the present disclosure provides a substantially homogeneously dispersed multimetal oxy-hydroxide catalyst comprising at least two metals, at least one of the metals being from a first class of metals which includes Ni, Fe, Co, Mn, Ti, Cu and Zn, and at least one metal or non-metal from a second class which are structurally dissimilar to the metals in the first class and includes W, Mo, Mn, Mg, Cr, Ba, Sb, Bi, Sn, Pb, Ce, Ir, Re, B and P. In this embodiment, the metals from the second class "modulate" the energy levels of the final catalyst to give better adsorption energetics of the intermediates of the electrochemical reaction for which the catalyst is designed.

While the catalysts produced herein have shown great efficacy and provide reduced overpotentials at given current densities for the oxygen evolution reaction, it will be appreciated that the design principles disclosed herein may be employed for designing catalysts for other electrochemical reactions, so that the present electrocatalysts are not restricted to the OER.

Although the foregoing invention has been described in some detail by way of illustration and example for purposes of clarity of understanding, one of skill in the art will appreciate that certain changes and modifications may be practiced within the scope of the appended claims.

REFERENCES

1. C. R. Cox, J. Z. Lee, D. G. Nocera, T. Buonassisi, *Proc. Natl. Acad. Sci. U.S.A.*, (2014).
2. J. Luo et al., *Science* 345, 1593 (2014).
3. M. Schreier et al., *Nat. Commun.* 6, (2015).
4. R. D. L. Smith et al., *Science* 340, 60 (2013).
5. D. Friebel et al., *J. Am. Chem. Soc.* 137, 1305 (2015).
6. J. Suntivich, K. J. May, H. A. Gasteiger, J. B. Goodenough, Y. Shao-Horn, *Science* 334, 1383 (2011).
7. M. W. Kanan, D. G. Nocera, *Science* 321, 1072 (2008).
8. M. Dincă, Y. Surendranath, D. G. Nocera, *Proc. Natl. Acad. Sci. U.S.A.* 107, 10337 (2010).
9. F. M. Toma et al., *Nat. Chem.* 2, 826 (2010).
10. Q. Yin et al., *Science* 328, 342 (2010).
11. J. A. Haber, E. Anzenburg, J. Yano, C. Kisielowski, J. M. Gregoire, *Advanced Energy Materials* 5, 1402307 (2015).
12. D. Friebel et al., *PCCP* 15, 17460 (2013).
13. W. Ma et al., *ACS Nano* 9, 1977 (2015).
14. R. Ma, J. Liang, K. Takada, T. Sasaki, *J. Am. Chem. Soc.* 133, 613 (2011).

What is claimed is:

1. A substantially homogeneously dispersed multimetal oxy-hydroxide catalyst having the general formula of $M(O_x(OH)_{2(1-x))n}$, wherein M represents at least two elements comprising at least one metal being a transition metal, and at least a second metal or a non-metal being structurally dissimilar to the at least one metal, wherein said transition metal is any one of Ni, Fe, Co, Cu and Zn, said second metal is any one of W, Mo, Mg, Ba, Sb, Bi, Sn, Ce, Pb, Ir and Re, and said non-metal is any one of B and P, x ranges between 0 and 1, and n is the metal valence;

wherein said at least one metal is connected to said at least second metal or said non-metal through a bridging oxygen or hydroxide such that the multimetal oxy-hydroxide is characterized by being substantially homogeneously dispersed on sub-10 nm scale and amorphous on both surface and bulk of the catalyst.

2. A multimetal catalyst characterized by being a reduced form of the homogeneously dispersed multimetal oxy-hydroxide catalyst of claim 1.

3. A multimetal catalyst characterized by being an electrochemically reduced form of the homogeneously dispersed multimetal oxy-hydroxide catalyst of claim 1.

4. A substantially homogeneously dispersed multimetal oxy-hydroxide catalyst having the general formula of $M(O_x(OH)_{2(1-x))n}$, wherein M represents at least two elements, comprising at least one metal being from a first class of metals which includes Ni, Fe and Co, and at least one metal or non-metal which are structurally dissimilar to the metal in the first class, the at least one metal being from a second class of metals which are structurally dissimilar to the metals in the first class and includes W, Mo, Mg, Ba, Sb, Bi, Sn, Ce, Pb, Ir and Re, and the non-metal being one of B and P, x ranges between 0 and 1, and n is the metal valence;

wherein said at least one metal from the first class of metals is connected to said at least one metal-through a bridging oxygen or hydroxide, and wherein the multimetal oxy-hydroxide catalyst is characterized by being amorphous on both surface and bulk of the catalyst.

5. A homogeneously dispersed multimetal oxy-hydroxide catalyst having the general formula of $M(O_x(OH)_{2(1-x))n}$, wherein M represents at least two elements with at least one of them being structurally dissimilar to the other element, said elements comprising:

a first metal being iron (Fe), a second metal being one or both of cobalt (Co) and nickel (Ni), and when the second metal is cobalt, including at least a third element M3 which is any one or combination of tungsten (W), molybdenum (Mo), and tin (Sn);

when the second metal is nickel, including the third element M3 which is any one of antimony (Sb), rhenium (Re), iridium (Ir), magnesium (Mg), boron (B) and phosphorus (P); and when the second metal is both cobalt (Co) and nickel (Ni), including the third element M3 which is at least one of boron (B) and phosphorus (P), x ranges between 0 and 1, and n is the metal valence;

wherein said first metal is connected to said second metal or said third element through a bridging oxygen or hydroxide, and wherein the multimetal oxy-hydroxide catalyst is characterized by being amorphous on both surface and bulk of the catalyst.

6. The catalyst according to claim 5 wherein when the second metal is cobalt, a ratio of the Fe:Co:M3 being 1:X:Y, wherein X ranges from about 0.1 to about 10, and Y ranges from about 0.001 to about 10.

7. The catalyst according to claim 5 wherein when the second metal is cobalt, a ratio of the Fe:Co:M3 being 1:X:Y, wherein X ranges from about 0.5 to about 1.5, Y ranges from about 0.5 to about 1.5.

8. The catalyst according to claim 5 wherein when the second metal is nickel, a ratio of the Fe:Ni:M3 being 1:X:Y, wherein X ranges from about 0.1 to about 10, and Y ranges from about 0.001 to about 10.

9. The catalyst according to claim 5 wherein when the second metal is nickel, a ratio of the Fe:Ni:M3 being 1:X:Y, wherein X ranges from about 5 to about 10, Y ranges from about 0.5 to about 1.5.

10. The catalyst according to claim 5 wherein when the second metal is cobalt and the third element is tungsten (W), including a fourth element which is molybdenum (Mo).

11. The catalyst according to claim 10 wherein a ratio of the Fe:Co:W:Mo being about 1:X:Y:Z, wherein X ranges from about 0.1 to about 10, Y ranges from about 0.001 to about 10, and Z ranges from about 0.001 to about 10.

12. The catalyst according to claim 5 wherein when the second metal is both cobalt (Co) and nickel (Ni), and the third element is phosphorus (P).

13. The catalyst according to claim 12 wherein a ratio of the FeCoNiP is 1:X:Y:Z wherein X ranges 0.1-10, Y ranges 1-100 and Z ranges 0.001-10.

14. The catalyst according to claim 12 wherein a ratio of the FeCoNiP is 1:1:9:0.1.

15. An electrochemically active electrode, comprising:

a) a conductive substrate; and b) a catalyst layer of claim 1 deposited on a surface of the conductive substrate.

16. The electrode according to claim 15 for use as an oxygen evolution reaction electrode.

17. An oxygen evolution electrode, comprising:

a) a conductive substrate; and b) a homogeneously dispersed multimetal oxy-hydroxide catalyst coated on said conductive substrate, said homogeneously dispersed multimetal oxy-hydroxide catalyst having the general formula of $M(O_x(OH)_{2(1-x))n}$, wherein M represents multimetals comprising at least iron (Fe), cobalt (Co) and tungsten (W), a ratio of the Fe:Co:W being about 1:X:Y, where X ranges from about 0.1 to about 10, Y ranges from about 0.001 to about 10, x ranges between 0 and 1, and n is the metal valence;

wherein said iron (Fe), cobalt (Co) and tungsten (W) are connected to each other through a bridging oxygen or hydroxide, and wherein the multimetal oxy-hydroxide catalyst is characterized by being amorphous on both surface and bulk of the catalyst.

18. The electrode according to claim 17 wherein the ratio Fe:Co:W is about 1:1:0.7.

19. The electrode according to claim 17, further comprising molybdenum, a ratio of the Fe:Co:W:Mo being about 1:X:Y:Z, wherein X ranges from about 0.1 to about 10, Y ranges from about 0.001 to about 10, and Z ranges from about 0.001 to about 10.

20. The electrode according to claim 19 wherein 1:X:Y:Z is about 1.1:0.5:0.5.

21. An oxygen evolution electrode, comprising:

a) a conductive substrate; and b) a homogeneously dispersed multimetal oxy-hydroxide catalyst coated on said conductive substrate, said homogeneously dispersed multimetal oxy-hydroxide catalyst having the general formula of $M(O_x(OH)_{2(1-x))n}$, wherein M represents multimetals comprising at least iron (Fe), cobalt (Co) and molybdenum (Mo), a ratio of the Fe:Co:Mo being about 1:X:Y, where X ranges from about 0.1 to about 10, and Y ranges from about 0.001 to about 10, x ranges between 0 and 1, and n is the metal valence;

wherein said iron (Fe), cobalt (Co) and molybdenum (Mo) are connected to each other through a bridging oxygen or hydroxide, and wherein the multimetal oxy-hydroxide catalyst is characterized by being amorphous on both surface and bulk of the catalyst.

22. The electrode according to claim 21 wherein X ranges from about 0.9 to about 1.1, Y ranges from about 0.6 to about 0.9.

23. An oxygen evolution electrode, comprising:

a) a conductive substrate; and b) a homogeneously dispersed multimetal oxy-hydroxide catalyst coated on said conductive substrate, said homogeneously dispersed multimetal oxy-hydroxide catalyst having the general formula of $M(O_x(OH)_{2(1-x))n}$, wherein M represents multimetals comprising at least iron (Fe), cobalt (Co), nickel (Ni), and phosphorus (P), a ratio of the Fe:Co:Ni:P being about 1:X:Y:Z, where X ranges from about 0.1 to about 10, Y ranges from about 1 to about 100, and Z ranges from about 0.001 to about 10 x ranges between 0 and 1, and n is the metal valence;

wherein said iron (Fe), cobalt (Co), nickel (Ni), and phosphorus (P) are connected to each other through a bridging oxygen or hydroxide, and wherein the multimetal oxy-hydroxide catalyst is characterized by being amorphous on both surface and bulk of the catalyst.

24. The electrode according to claim 23 wherein X ranges from about 0.9 to about 1.1, Y ranges from about 8 to about 10, Z ranges from about 0.05 to about 0.2.

25. An oxygen evolution electrode, comprising:

a) a conductive substrate; and b) a homogeneously dispersed multimetal oxy-hydroxide catalyst coated on said conductive substrate, said homogeneously dispersed multimetal oxy-hydroxide catalyst having the general formula of $M(O_x(OH)_{2(1-x))n}$, wherein M represents multimetals comprising at least iron (Fe), cobalt (Co), nickel (Ni), and boron (B), a ratio of the Fe:Co:Ni:B being about 1:X:Y:Z, where X ranges from about 0.1 to about 10, Y ranges from about 1 to about 100, and Z ranges from about 0.001 to about 10, x ranges between 0 and 1, and n is the metal valence;

wherein said iron (Fe), cobalt (Co), nickel (Ni), and boron (B) are connected to each other through a bridging oxygen or hydroxide, and wherein the multimetal oxy-hydroxide catalyst is characterized by being amorphous on both surface and bulk of the catalyst.

26. The electrode according to claim 25 wherein X ranges from about 0.9 to about 1.1, Y ranges from about 8 to about 10, Z ranges from about 0.05 to about 0.2.

27. An oxygen evolution electrode, comprising:

a) a conductive substrate; and b) a homogeneously dispersed multimetal oxy-hydroxide catalyst coated on said conductive substrate, said homogeneously dispersed multimetal oxy-hydroxide catalyst having the general formula of $M(O_x(OH)_{2(1-x))n}$, wherein M represents multimetals comprising at least iron (Fe), nickel (Ni), and magnesium (Mg), a ratio of the Fe:Ni:Mg being about 1:X:Y, where X ranges from about 1 to about 100, and Y ranges from about 0.001 to about 10, x ranges between 0 and 1, and n is the metal valence;

wherein said iron (Fe), nickel (Ni), and magnesium (Mg) are connected to each other through a bridging oxygen or hydroxide, and wherein the multimetal oxy-hydroxide catalyst is characterized by being amorphous on both surface and bulk of the catalyst.

28. The electrode according to claim 27 wherein X ranges from about 4 to about 8, Y ranges from about 0.4 to about 0.8.

29. The electrode according to claim 27 wherein X is 6, and Y is 0.6.

30. The catalyst according to claim 1, wherein x is greater than 0, and less than 1.

* * * * *